US006769513B2

(12) United States Patent
Pettit

(10) Patent No.: US 6,769,513 B2
(45) Date of Patent: Aug. 3, 2004

(54) SWIMMING POOL LADDER

(76) Inventor: Frederick M. Pettit, 2111 Merrittville Hwy., Fonthill Ontario (CA), L0S 1E6

( * ) Notice: Subject to any disclaimer, the term of this patent is extended or adjusted under 35 U.S.C. 154(b) by 0 days.

(21) Appl. No.: 10/042,110

(22) Filed: Jan. 8, 2002

(65) Prior Publication Data

US 2003/0079942 A1 May 1, 2003

Related U.S. Application Data

(63) Continuation-in-part of application No. 10/012,765, filed on Oct. 30, 2001, now abandoned.

(51) Int. Cl.[7] ..... E06C 7/16; E06C 7/18
(52) U.S. Cl. ..... 182/115; 182/106
(58) Field of Search ..... 182/151, 180.1, 182/115, 117, 118, 106, 46, 194

(56) References Cited

U.S. PATENT DOCUMENTS

| | | | | |
|---|---|---|---|---|
| 3,288,248 A | | 11/1966 | Gurian et al. | |
| 4,023,647 A | * | 5/1977 | Confer | 182/118 X |
| 4,997,061 A | * | 3/1991 | Aymes | 182/118 X |
| 5,366,051 A | * | 11/1994 | Bartnicki et al. | 182/46 |
| 6,102,156 A | * | 8/2000 | Lipniarski | 182/118 |

* cited by examiner

*Primary Examiner*—Hugh B. Thompson, II
(74) *Attorney, Agent, or Firm*—Joseph P. Gastel

(57) ABSTRACT

A molded plastic pool ladder of A-frame shape having first and second sides consisting of assembled frame channel rail structures with a ladder slidable between lower and higher positions in one of the frame channel rail structures and movable feet on the bottom of the frame channel rail structures and a platform connected to the frame channel rail structures by a button connection.

50 Claims, 19 Drawing Sheets

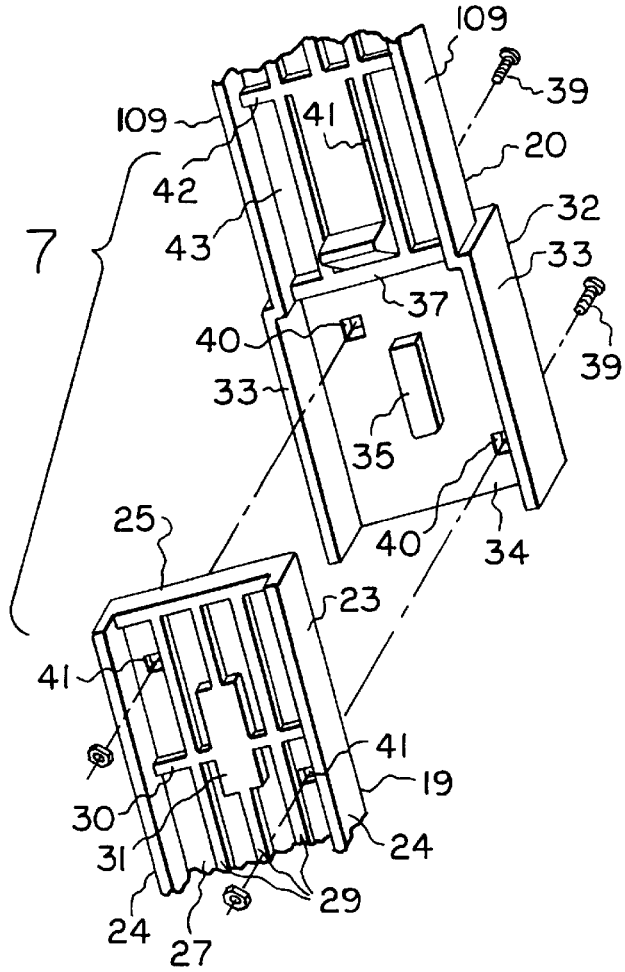
FIG. 7
FIG. 8
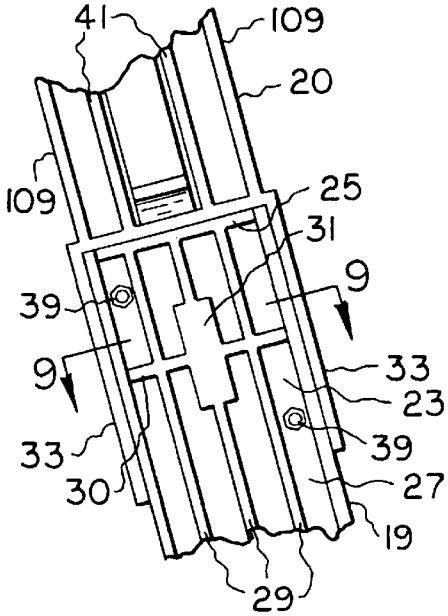
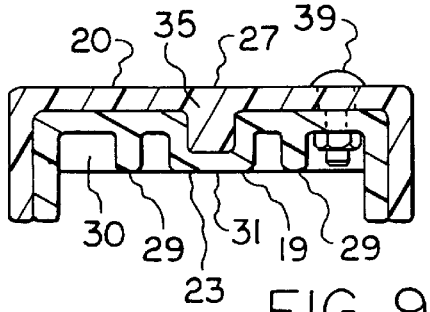
FIG. 9
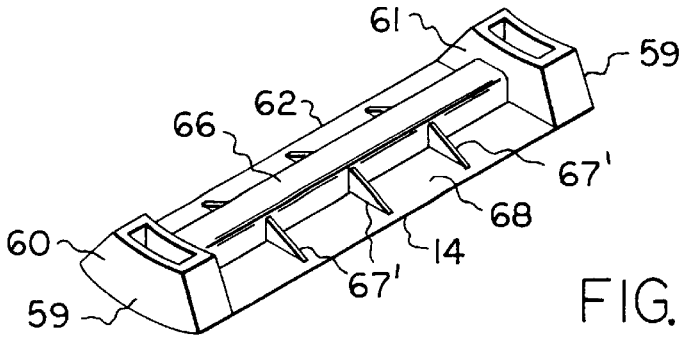
FIG. 3A

FIG. 11
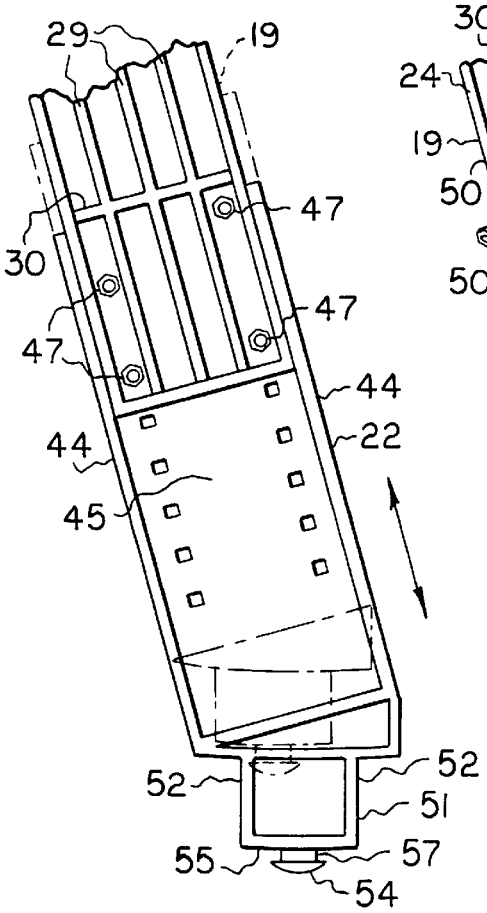
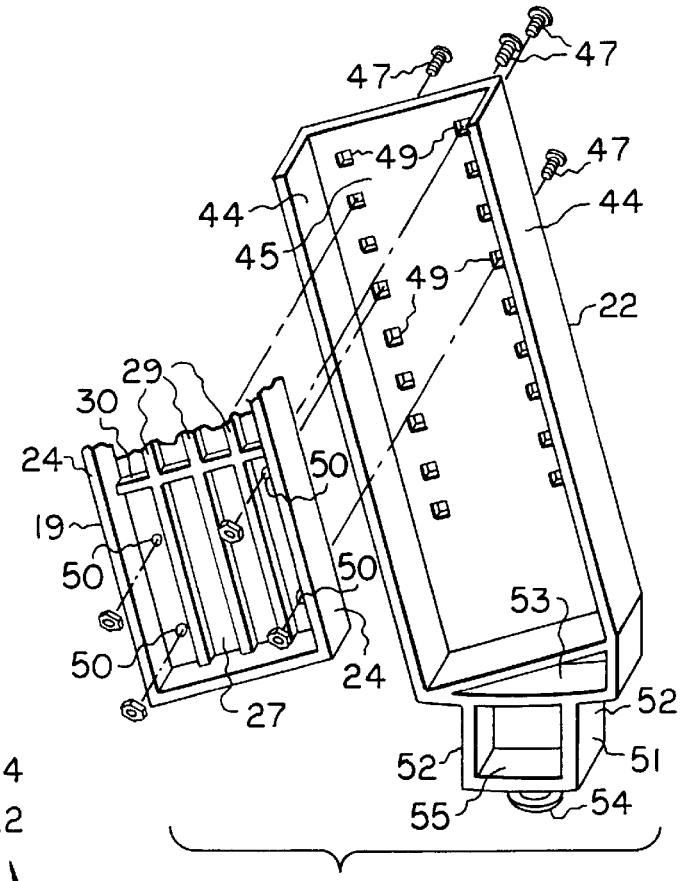
FIG. 10
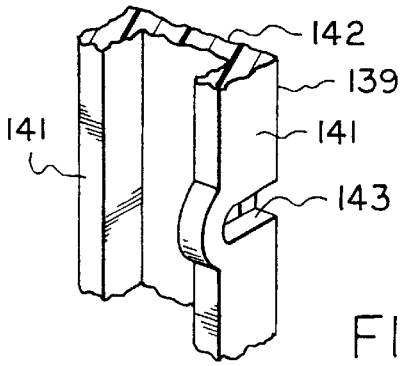
FIG. 12A
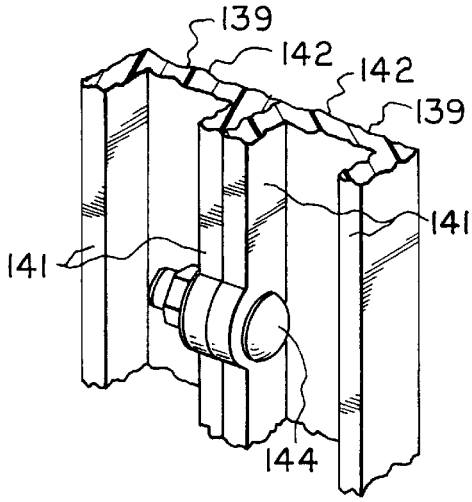
FIG. 12B

FIG. 13
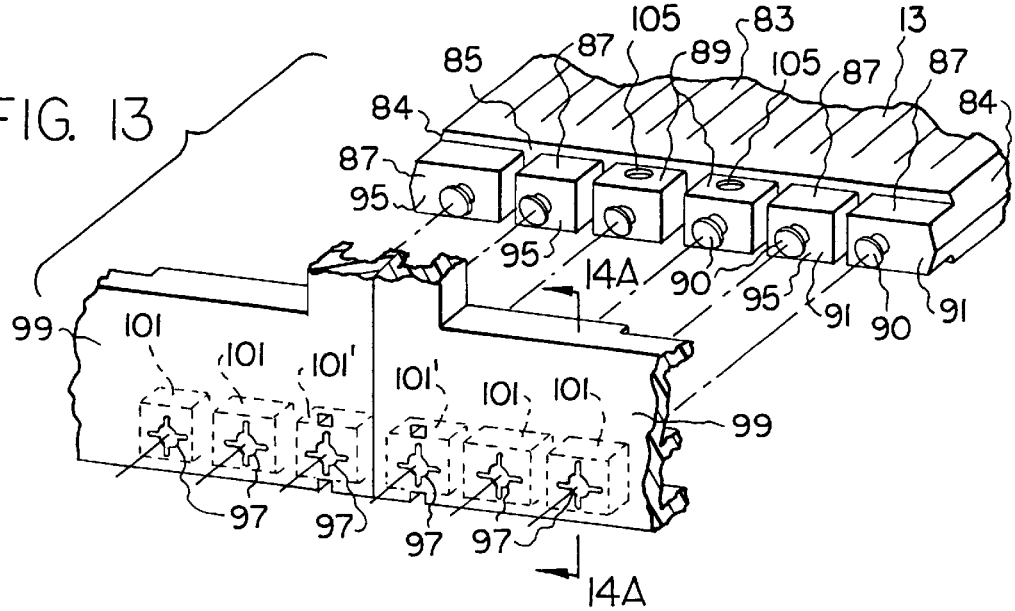
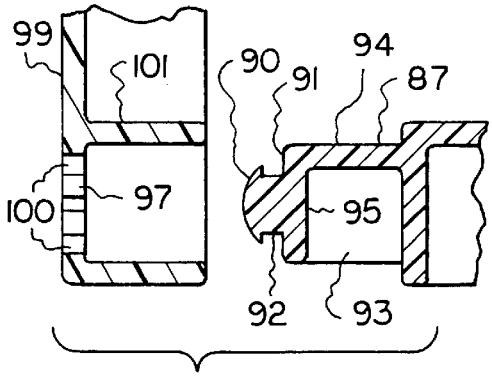
FIG. 14A
FIG. 14B
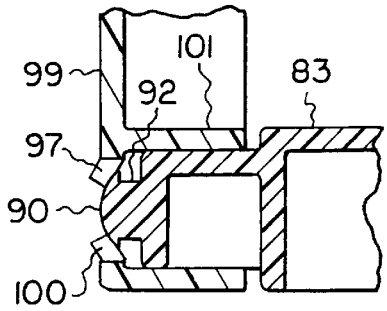
FIG. 14C
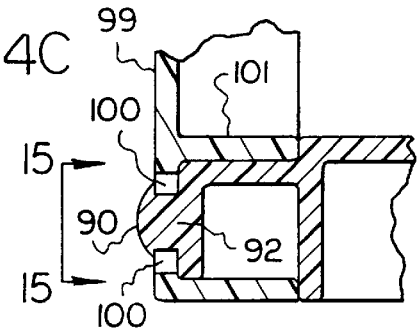
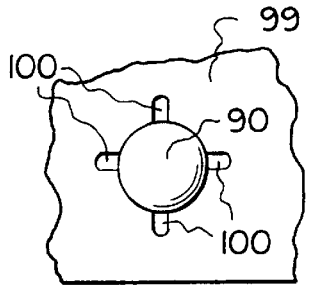
FIG. 15

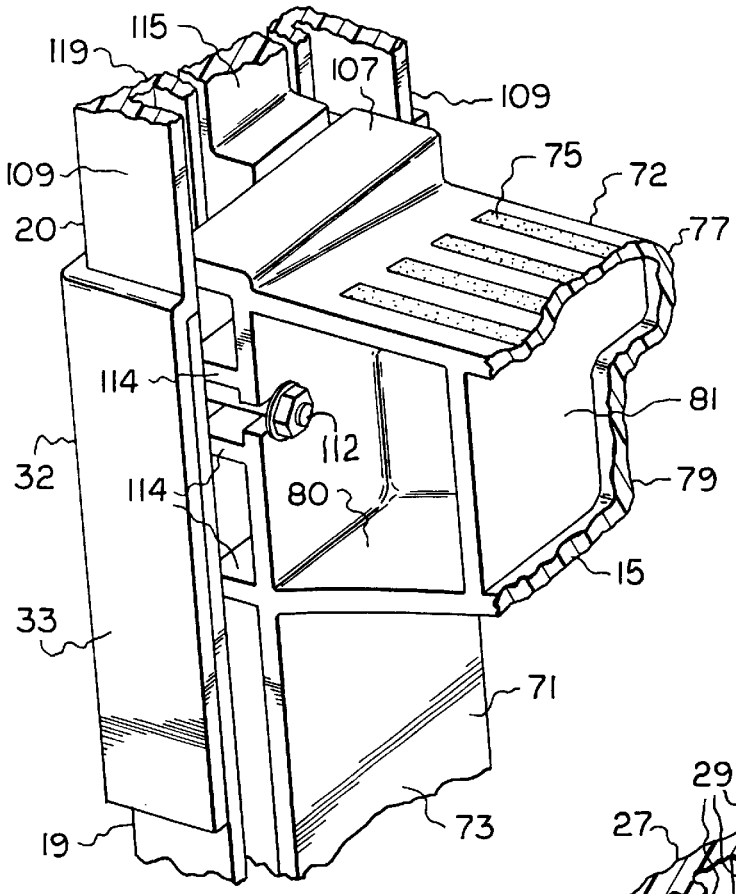
FIG. 20
FIG. 21
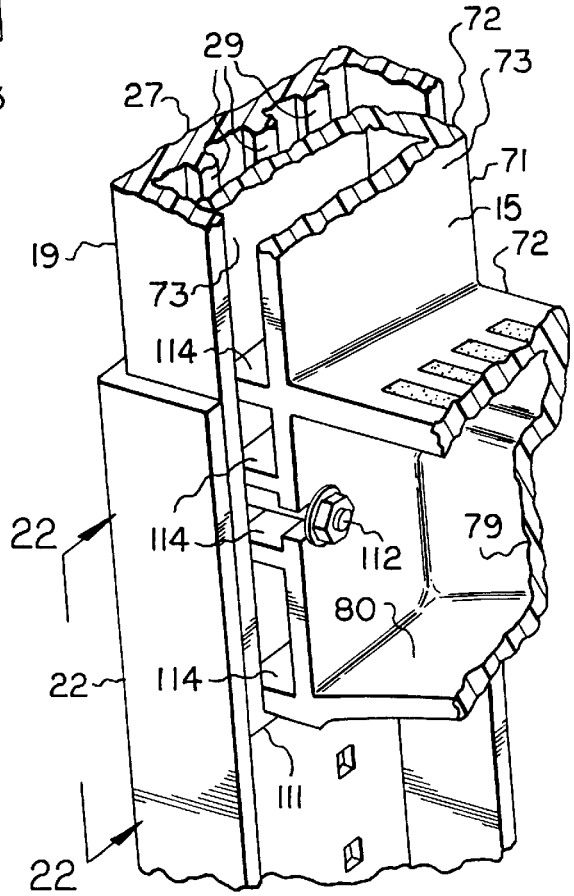
FIG. 22
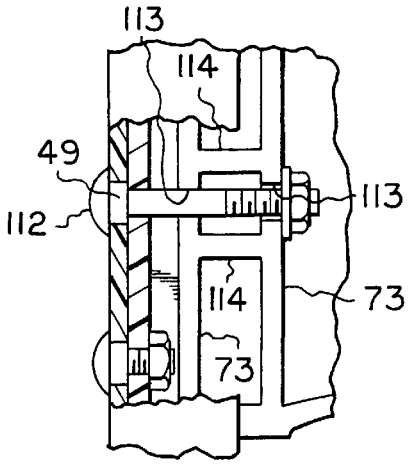

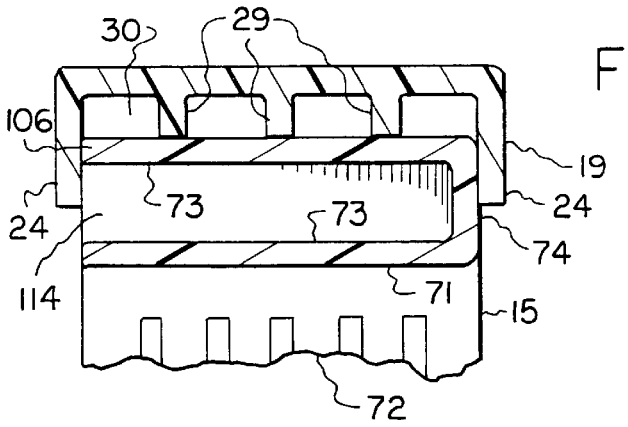
FIG. 29
FIG. 30
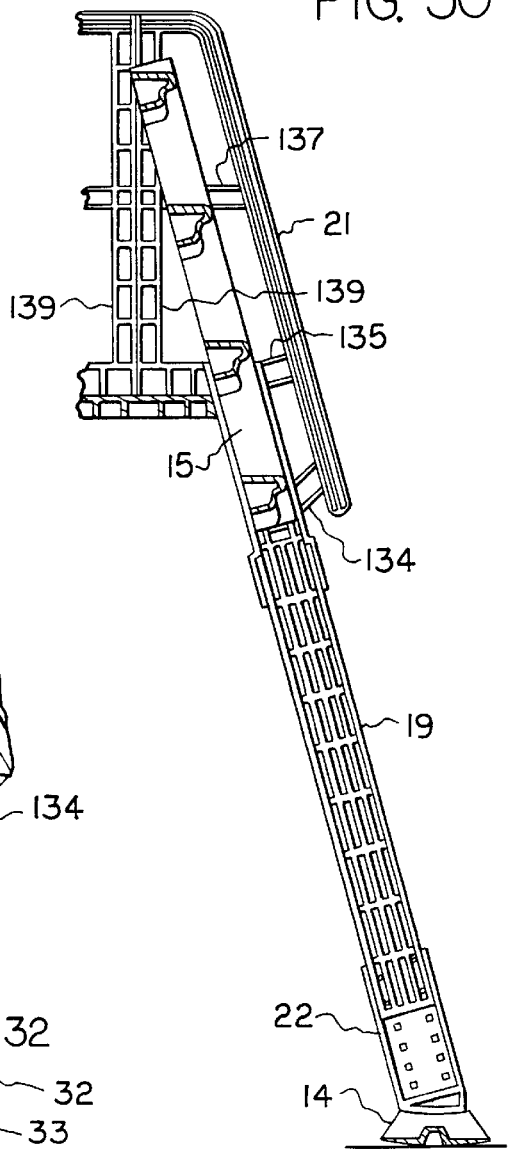
FIG. 31
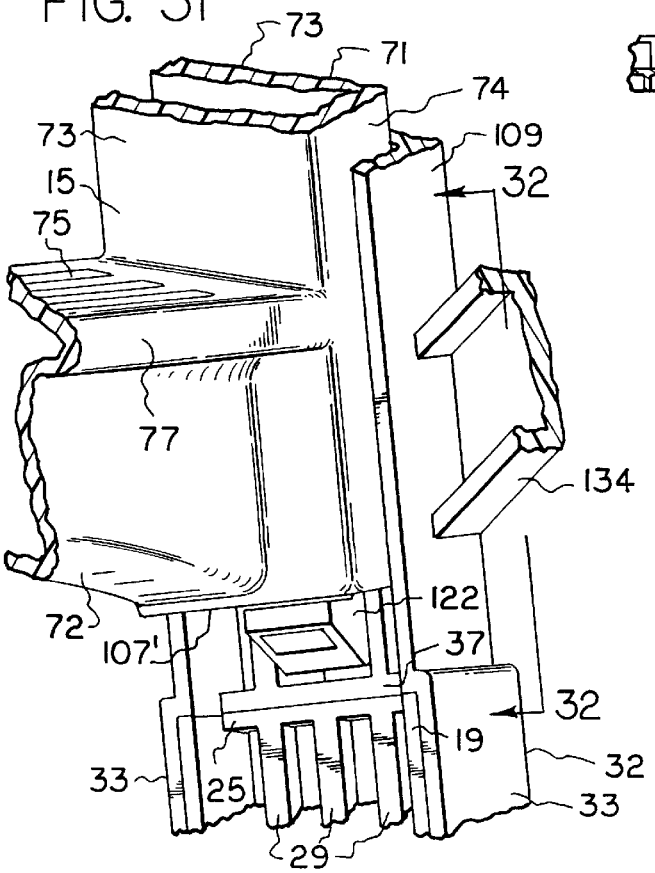

SWIMMING POOL LADDER

CROSS-REFERENCE TO RELATED APPLICATIONS

The present application is a continuation-in-part of application Ser. No. 10/012,765, filed Oct. 30, 2001, now abandoned.

STATEMENT REGARDING FEDERALLY SPONSORED RESEARCH OR DEVELOPMENT

Not Applicable

BACKGROUND OF THE INVENTION

The present invention relates to an improved swimming pool ladder.

By way of background, swimming pool ladders of an A-frame type are positioned straddling the pool wall with the pool side having a ladder for entering and leaving the water and an outside ladder for climbing over the outside of the pool wall. In the past certain ladders of the foregoing type were not adjustable in height. Other ladders had relatively unwieldy structures for placing the outside ladder in an inaccessible position so as to prevent unauthorized entry into the pool. Also, insofar as known, ladders of the foregoing type, when disassembled, were not of a size which would fit into a box which was within the dimensions acceptable to commercial shippers. Other types of pool ladders were relatively complicated and difficult to assemble.

BRIEF SUMMARY OF THE INVENTION

It is one object of the present invention to provide an improved molded plastic A-frame type of pool ladder which consists of parts which can be assembled primarily by snapping the parts together and the use of very few bolts.

Another object of the present invention is to provide an improved molded plastic A-frame type of pool ladder consisting of parts having dimensions which will fit into boxes which are acceptable to large scale commercial shippers.

A further object of the present invention is to provide an improved A-frame type of pool ladder wherein the ladder on the outside of the pool wall can be slid to an elevated position and latched therein.

Yet another object of the present invention is to provide an improved A-frame type of pool ladder which is adjustable in height so that it can fit pools having walls of different heights.

A still further object of the present invention is to provide an assemblable A-frame type of ladder having bases which are movable so as to automatically position themselves in proper contact with the surfaces on which they rest.

The present invention relates to a molded plastic pool ladder comprising an A-frame, first and second sides on said A-frame, opposed channels on said first side, a first ladder, side rails on said first ladder in said opposed channels on said first side, and a second ladder on said second side.

The present invention also relates to a molded plastic pool ladder comprising an A-frame, first and second sides on said A-frame, first and second apertures in said first and second sides of said A-frame, a platform, first and second sides on said platform, and first and second buttons on said first and second sides of said platform received in said first and second apertures.

The present invention also relates to a molded plastic pool ladder comprising a plurality of assemblable parts including four central frame channel rails, four top frame channel rails, four bottom frame channel rails, a platform, and two ladders.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 3A is an enlarged perspective view of the base which is attached to the bottom frame channel rails;

FIG. 7 is a fragmentary perspective exploded view showing the manner in which the frame channel rail is attached to the top frame rail extension;

FIG. 8 is a fragmentary side elevational view taken substantially along line 8—8 of FIG. 5 without the tread of the ladder and showing the parts of FIG. 7 assembled;

FIG. 9 is a cross sectional view taken substantially along line 9—9 of FIG. 8;

FIG. 10 is a fragmentary perspective exploded view showing the structure for securing the bottom frame channel rail extension to the frame channel rail;

FIG. 11 is a view taken substantially in the direction of arrows 11—11 of FIG. 5 without the tread and showing the parts of FIG. 10 assembled;

FIG. 12A is a fragmentary perspective view of a portion of the center post of the hand rail structure with the bolt-receiving slot therein;

FIG. 12B is a fragmentary perspective view of the two halves of the center post secured to each other with one of the bolts;

FIG. 13 is a fragmentary perspective view showing the structure for attaching the platform to the base of the two assembled hand rail structures;

FIG. 14A is a fragmentary cross sectional view taken substantially along line 14A—14A of FIG. 13 and showing the connecting portion of the platform approaching the bottom of the base of the two assembled hand rail structures;

FIG. 14B is a cross sectional view similar to FIG. 14A but showing the parts of FIG. 14A partially assembled;

FIG. 14C is a cross sectional view similar to FIGS. 14A and 14B but showing the parts fully assembled;

FIG. 15 is a fragmentary side elevational view taken substantially in the direction of arrows 15—15 of FIG. 14C;

FIG. 20 is a fragmentary perspective view taken substantially along line 20—20 of FIG. 1 and showing the manner in which the in pool ladder is locked to both the frame channel rail and the top frame channel rail extension;

FIG. 21 is a fragmentary perspective view taken substantially along line 21—21 of FIG. 1 and showing the structure for positively locking the pool ladder to the bottom end of the frame ladder channel rail and the bottom frame channel rail extension;

FIG. 22 is a broken away fragmentary side elevational view taken substantially in the direction of arrows 22—22 of FIG. 21 and showing the structure for positively locking the parts of FIG. 21 together;

FIG. 29 is a fragmentary cross sectional view taken substantially along line 29—29 of FIG. 26 and showing the relationship between the ladder rail and the frame channel rail;

FIG. 30 is a fragmentary cross sectional view similar to FIG. 26 but showing the external ladder in its upper position;

FIG. 31 is a fragmentary perspective view of the ladder in its upper position on the frame channel rail and latched in position;

DETAILED DESCRIPTION OF THE INVENTION

Figure 2:
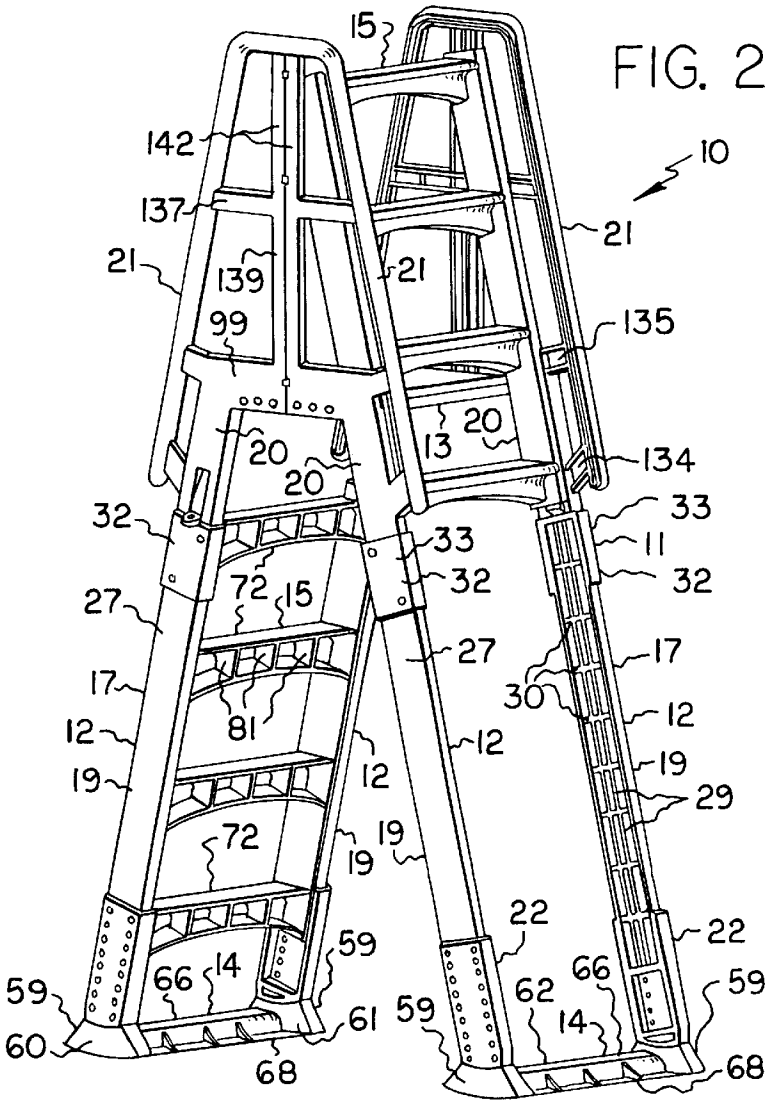
FIG. 2 is a view similar to FIG. 1 but showing the external pool ladder portion in an up and locked position.

Summarizing briefly in advance, the improved plastic pool ladder of the present invention comprises a plurality of molded plastic parts which are of a size so that they can be packaged conveniently for shipping within containers which are readily acceptable by the shippers and which can be assembled by interfitting connections and the use of a simple tool such as a wrench. Additionally, the assembled parts have a unique relationship wherein the external pool ladder can be placed in an elevated inaccessible position and latched therein to prevent its use for entry into the pool. Additionally, the A-frame of the ladder is assembled by the use of interfitting parts so that it is extremely stable and movable feet are secured to the ladder to further enhance the stability and also sit squarely on pool liners thereby avoiding the tearing thereof.

The improved pool ladder 10 includes a plurality of molded plastic parts, certain of which are identical and assembled in mirror-image relationship to provide the completed pool ladder assembly 10 (FIGS. 1, 2,4 and 5). At this point it will be noted that the mirror-image parts described hereafter are identical and will be designated by the same numbers even though they are assembled in mirror-image relationship, as will be apparent from the drawings. As noted above, all parts are fabricated of molded high density polyethylene or polypropylene.

The improved pool ladder 10 includes an A-frame 11 formed of assembled opposed frame channel rail structures 12; a platform 13 connected to the assembled frame rail structures at their upper ends; and pivotal bases or feet 14 at the lower ends of the assembled frame rail structures. Ladders 15 are positioned in opposite sides 17 of the A-frame.

Each side 17 of the A-frame includes opposed central frame channel rails 19 (FIGS. 2 and 3) to which are connected top frame channel rails 20 which have hand rails 21 molded integrally therewith. As can be seen from FIG. 4, the hand rails 21 extend downwardly below the top rail 108 of the pool wall 26. Bottom frame channel rails 22 are suitably secured to the lower ends of central frame channel rails 19. Bases or feet 14 are suitably secured to bottom frame channel rails 22. Top frame channel rails 20 are attached to central frame channel rails 19 as shown in FIGS. 7–9. More specifically, each central frame channel rail 19 has a pair of sides 24 and an end 25. Sides 24 are molded integrally with web 27 to form a channel structure. Longitudinal ribs 29 and cross ribs 30 are molded integrally with web 27 and sides 24 (FIGS. 2, 8 and 9). A hollow box-like portion 31 (FIGS. 7, 8 and 9) is also molded integrally into web 27. The lower end 32 of top frame channel rail 20 includes enlarged sides 33 which are molded integrally with web 34 having a protrusion 35 thereon which fits into complementary mating relationship with box 31. Sides 33 also bracket sides 24 of central frame channel rail 19 in complementary mating relationship. The foregoing comprise interfitting connections. Also, ledge 37 of top frame channel rail 20 rests on top 25 of central frame channel rail 19. Bolts 39 extend through aligned apertures 40 and 41 in webs 34 and 27, respectively, to firmly secure top frame channel rail 20 to central frame channel rail 19. Top frame channel rail 20 has longitudinal ribs 41 and cross ribs 42 molded integrally with web 43 thereof.

Bottom frame channel rails 22 are secured to the lower ends of central frame channel rails 19 in the following manner (FIGS. 10 and 11). Sides 24 of central frame channel rail 19 are placed within sides 44 of bottom frame channel rail 22 with web 27 of central frame channel rail 19 abutting web 45 of bottom frame channel rail 22. The foregoing comprise interfitting connections. Bolts 47 are installed through aligned apertures in webs 45 and 27, respectively. As can be seen from FIGS. 10 and 11, there are numerous apertures 49 in bottom frame channel rail 22 which permits the ladder to be adjusted so that the entire frame channel rail can be of any desired height, preferably one where the platform 13 bears against the top edge of the pool wall. Also, the sides 17 of the A-frame can be of different lengths to cause the ladder to be symmetrically positioned about a vertical centerline in the event that the ground and the pool floor are of different heights.

Figure 18:
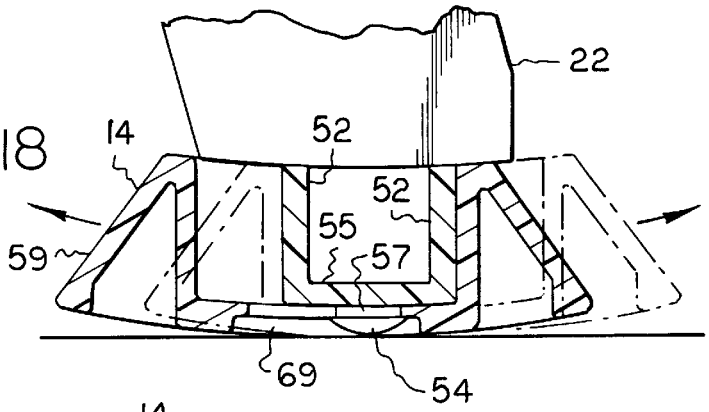
FIG. 18 is a fragmentary cross sectional view which is similar to FIG. 17 but showing the pivotal base in an adjusted position for bearing properly on the underlying surface.
Figure 19:
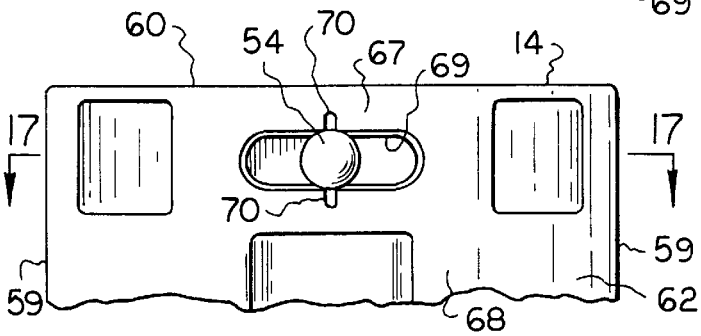
FIG. 19 is a fragmentary bottom plan view of the base taken substantially in the direction of arrows 19—19 of FIG. 17.

The bases or feet 14 are secured to bottom frame channel rails 22 in the following manner (FIGS. 10, 16, 17, 18 and 19). The bottom frame channel rail 22 includes a box-like extension 51 (FIGS. 10 and 11) having sides 52 which are molded integrally with the side 53 which is molded integrally with the remainder of the bottom frame channel rail 22. A button 54 is molded integrally with bottom 55 of box 51 by neck 57 (FIG. 11). The base 14 (FIGS. 2, 3, 16, 17, 18 and 19) includes two ends 59 (FIG. 3) shaped as shown with outer walls 60 and inner walls 61 with the inner walls 61 connected by an integrally molded central portion 62 consisting of a ridge 66 (FIGS. 3 and 16) and a curved plate 68 with a plurality of integrally molded gussets 67' therebetween on opposite sides of said ridge 66. A box-like structure 63 is formed in portions 59 of base 14. Box-like structure 63 includes walls 64 and walls 65 and a bottom 67. The sides 52 of box-like extension 51 guide walls 65 of box-like structure 63 for rectilinear movement. An elongated slot 69 (FIGS. 16–19) is formed in bottom wall 67, and it has opposed slots 70 in bottom wall 67 which are in communication with slot 69. The plastic wall 67 is flexible so that button 54 can be pushed through the slot 69 in bottom wall 67 and neck 57 will be captured within slot 69. Because box 63 is elongated and because slot 69 is elongated, the portion 59 can rock relative to bottom frame channel rail 22 within the confines of slot 69, as depicted in FIG. 18, to thereby firmly rest on any surface on which it is placed.

Figure 3:
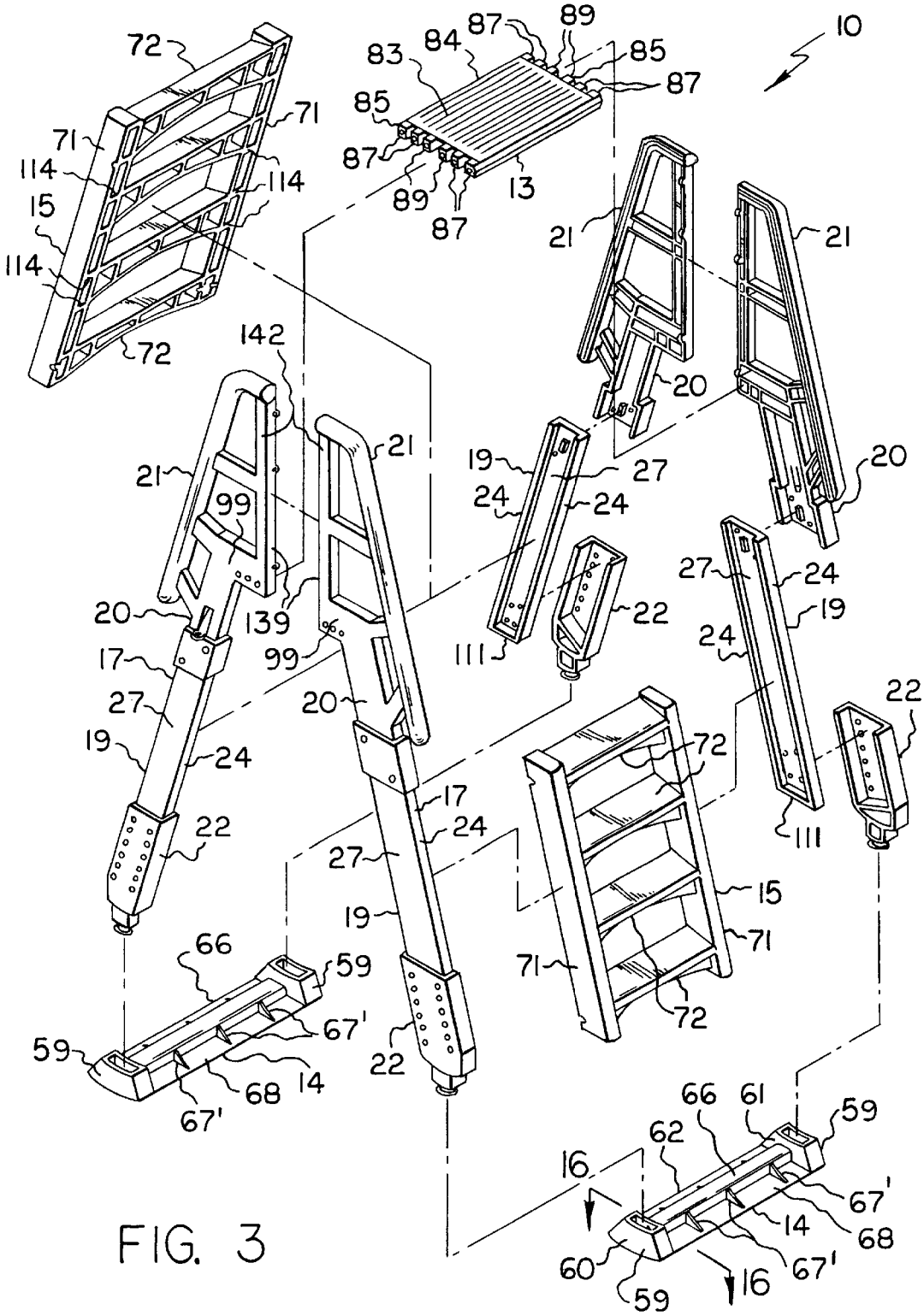
FIG. 3 is a perspective view of the ladder assembly showing certain parts fully exploded and other parts assembled.
Figure 6:
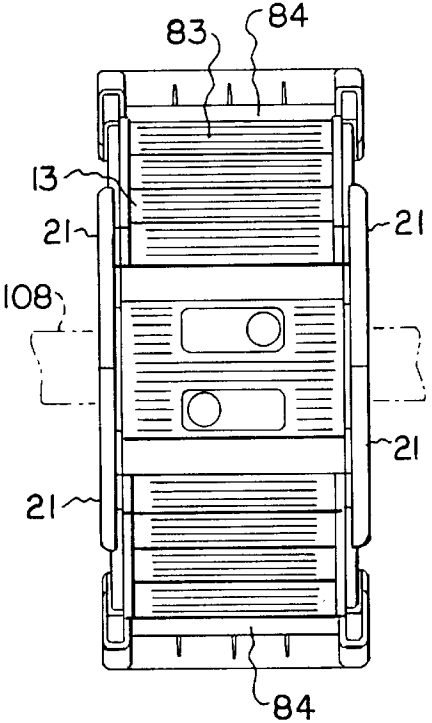
FIG. 6 is a plan view of the ladder assembly showing the platform which extends across the top of the pool.
Figure 5:
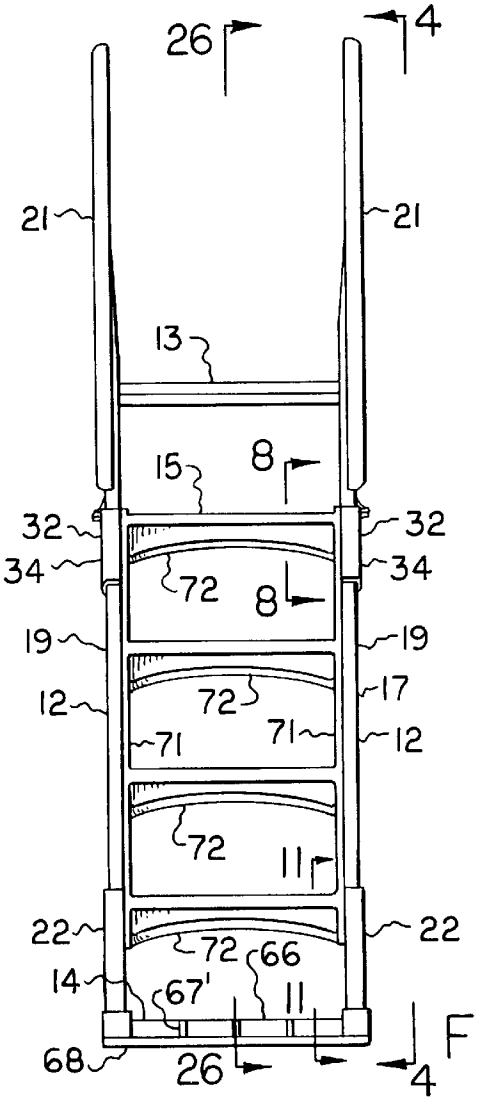
FIG. 5 is an end elevational view of the ladder assembly taken substantially in the direction of arrows 5—5 of FIG. 4.

The ladder assembly also includes a one-piece molded ladder 15 which includes ladder rails 71 and integrally molded treads 72 (FIG. 3). The ladder rails 71 are of U-shaped configuration connected by integrally molded treads 72 (FIG. 3) having anti-skid ribs in their upper surfaces. The ladder rails 71 are U-shaped (FIGS. 20, 21, 28, 29 and 31) and consist of sides 73 connected by a web 74 (FIGS. 29 and 31). The treads or steps 72 have an upper portion 75, an edge 77 and an undersurface 79 which merges into a lowermost portion 80 (FIG. 21). The opposite ends of the treads 72 are molded integrally with one of the U-shaped sides 73 of the ladder rails 71. Ribs 81 (FIGS. 2 and 20) have their edges molded integrally with the entire inner surface of the treads 72 which they engage. When the ladders are assembled into the A-frame, the upper surfaces of the treads or steps tilt inwardly to the vertical centerline at a 5° angle to the horizontal so as to cause a person's foot to be biased toward the vertical centerline in the event the foot slips.

The ladder assembly 10 also includes a platform 13 (FIGS. 1, 3, 6, 13, 23, 24, 25). The platform 13 includes an upper surface 83, ends 84 and two opposed sides 85 (FIGS. 3 and 13) which are mirror images of each other, with only one side 85 being fragmentarily shown in detail in FIG. 13. The upper surface 83 of the platform has anti-skid ribs molded therein. Each side 85 has a plurality of inverted box-like structures 87 protruding therefrom and two box-like structures 89 protruding therefrom. Buttons 90 extend outwardly from each of the box-like structures. The buttons 90 are connected to the front walls 91 of the box-like structures by necks 92 (FIG. 14A). The box-like structures 87 each include opposed side walls 93, a top wall 94 and a front wall 95 (FIG. 14A) from which neck 92 and button 90 protrude. Box-like structures 89 have the same construction except that they include apertures 105 in their top walls.

Four of the above-described central frame channel rails 19, four of the top frame channel rails 20, four of the bottom frame channel rails 22, two of the bases 14, and the platform 13 are of a size so that they fit into a box or carton which is 47 inches long, 19½ inches wide and 16¾ inches high, and this size box is acceptable to commercial shippers, such as United Parcel Service (UPS), thereby facilitating the sending of the foregoing parts to the ultimate consumer. By way of further explanation, the UPS regulation regarding the carton size is that the longest dimension plus two times the width plus two times the height cannot exceed 130". The above dimensions of the carton calculate to 47+2(19½)+2(16¾)=119½" which is within the 130" maximum noted above. The dimensions of the individual parts are as follows:

Dimensions of Parts in Inches

| Part | Number of Pieces | Length | Width | Height |
|---|---|---|---|---|
| Platform 13 | 1 | 20.500 | 11.591 | 1.518 |
| Base 14 | 2 | 21.997 | 7.620 | 2.390 |

-continued

| Dimensions of Parts in Inches | | | | |
|---|---|---|---|---|
| Part | Number of Pieces | Length | Width | Height |
| Ladder 15 | 2 | 36.702 | 19.500 | 3.470 |
| Central rail 19 | 4 | 36.487 | 4.037 | 1.250 |
| Top rail 20 | 4 | 46.89 | 13.215 | 1.500 |
| Bottom rail 22 | 4 | 13.647 | 4.523 | 1.500 |

Figure 23:
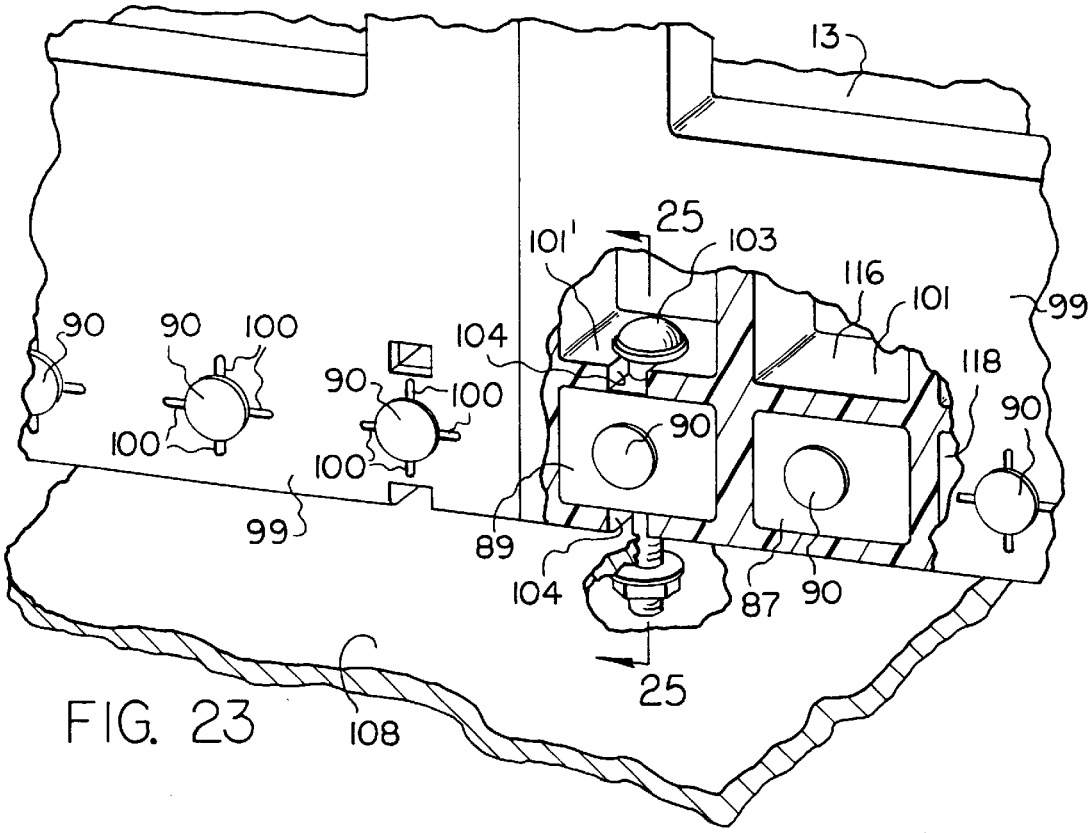
FIG. 23 is a broken away fragmentary perspective view partially in cross section showing the assembled bases of the hand rail structures and the platform secured to the top of the pool wall.

The ladder assembly 10 is assembled from the above described parts to the condition shown in FIG. 2 in the following manner. First of all, the top frame channel rails 20 are assembled with the central frame channel rails 19 in the above-described manner. The bottom frame channel rails 22 are also assembled with the central frame channel rails 19 in the above-described manner. Thus, there are provided the frame side subassemblies 17 shown at the left of FIG. 3. The next step in the process is to assemble platform 13 with the frame side subassemblies 17 which combine the central frame channel rails 19 with the top and bottom frame channel rails 20 and 22. This is accomplished by inserting the buttons 90 on opposite sides of platform 13 through apertures 97 (FIGS. 13 and 14A) in sides 99 of top frame channel rails 20. As noted above, the sides 99 are fabricated of plastic, and each aperture 97 has four slots 100 in communication therewith (FIGS. 15 and 23). Therefore, buttons 90 can be pushed through apertures 97 in sides 99 as depicted in FIGS. 14A, 14B, 14C and 15 because the borders of the apertures will yield and after the buttons have passed entirely through the apertures, the borders will snap back into their normal position to capture the buttons in the position of FIG. 14C.

Figure 24:
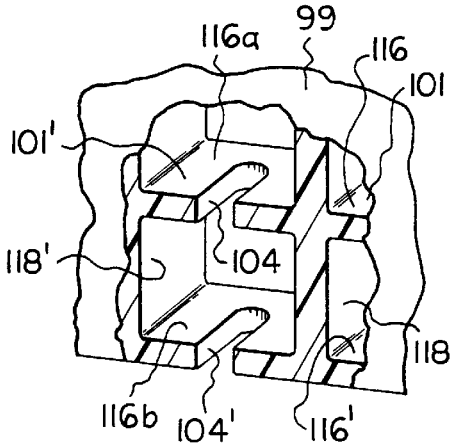
FIG. 24 is a broken away fragmentary perspective view partially in cross section showing the structure of the base of the hand rail structure.
Figure 25:
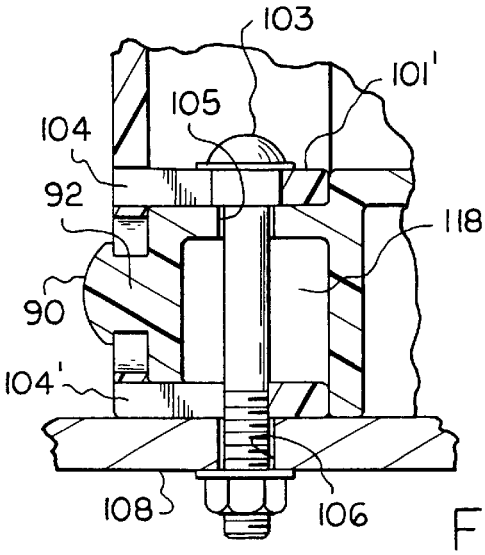
FIG. 25 is a fragmentary cross sectional view taken substantially along line 25—25 of FIG. 23.

During the assembly process, box-like structures 87 and 89 are inserted into box structures 101 and 101', respectively, which protrude from the inner surface of side 99. Each box structure 101 includes an upper wall 116 and a lower wall 116' (FIG. 24) and side walls 118 and 118' in addition to the portion of side 99 which serves as an end wall. The box structures 101' differ from box structures 101 in that they have opposed slots 104 and 104' in walls 116*a* and 116*b*, respectively (FIG. 24). There are two box structures 101 on the opposite sides of the two central box structures 101' (FIG. 13). FIG. 14A shows the boxes 87 approaching the side 99. FIG. 14B shows the button partially through aperture 97 and FIG. 14C shows the button 90 completely through aperture 97, with neck 92 captured within side 99. After the platform 13 has been assembled with four top frame channel rail extensions 20 in the above-described manner, bolts 103 (FIGS. 23 and 25) are inserted through aligned slots 104 and 104' in box walls 116*a* and 116*b* (FIG. 24) in boxes 101' and through apertures 105 (FIGS. 13 and 25) in boxes 89 to thereby firmly hold platform 13 in assembled relationship with the subassemblies noted above consisting of parts 19, 20 and 22 shown in the left of FIG. 3. Four bolts 103 also extend through apertures 106 in top ledge 108 of the pool wall to anchor the ladder assembly 10 to the pool wall.

Figure 1:
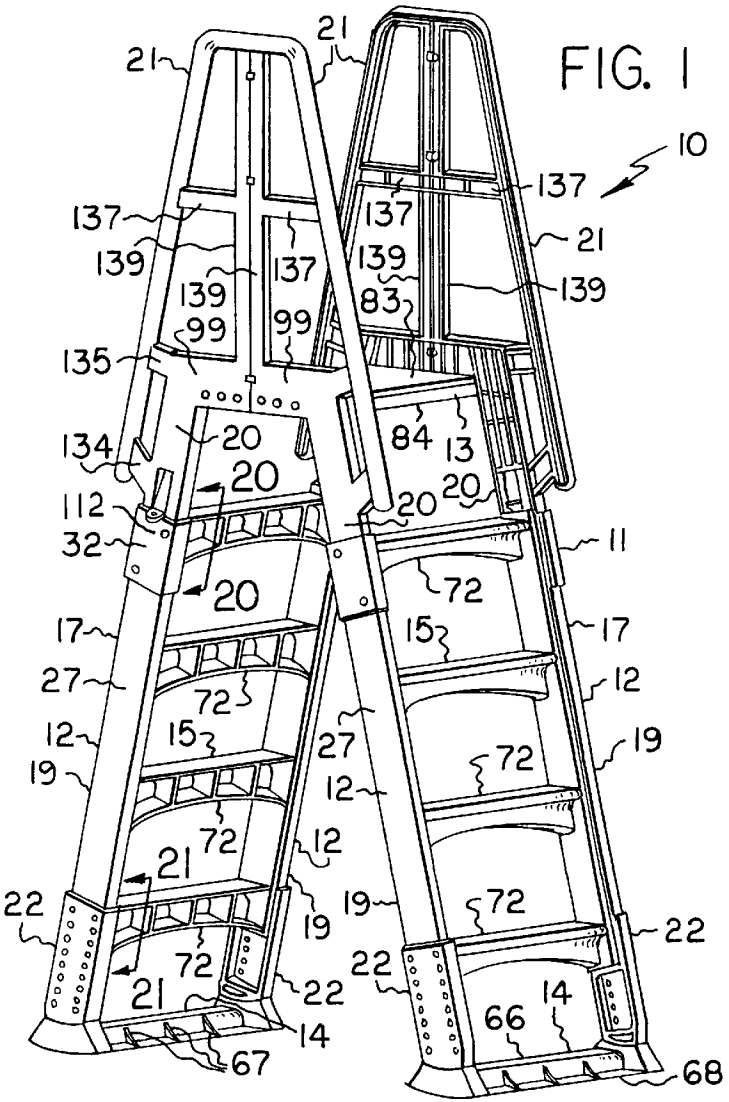
FIG. 1 is a perspective view of the improved pool ladder assembly of the present invention with the external pool ladder portion in a down position.
Figure 27:
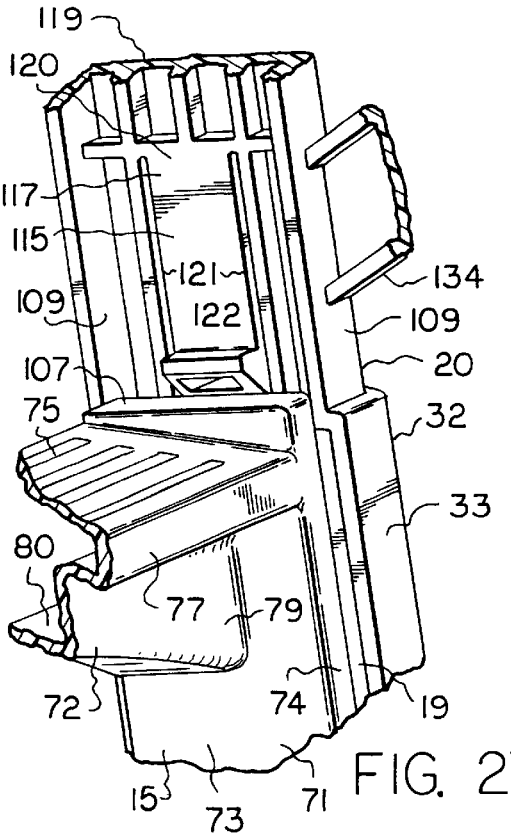
FIG. 27 is a fragmentary enlarged perspective view showing the upper portion of the external ladder in its lowermost position below the latching structure of the hand rail structure.

After the foregoing assembly has been completed, ladders 15 are installed into the channels provided by opposed central frame channel rails 19 and opposed top frame channel rails 20 so as to assume the positions shown in FIG. 1. In this respect, the web 74 (FIG. 29) of each channel of each ladder rail 71 will be adjacent one leg 24 of each central frame channel rail 19 and the end 106 (FIG. 29) will also be adjacent leg 24 of central frame channel rail 19. In addition, the top side 107 of each ladder rail 71 (FIG. 20) will be positioned between the lowermost ends of sides 109 (FIG. 20) of top frame channel rails 20 (FIGS. 20 and 27). The bottom end 110 of each ladder rail 71 (FIG. 28) includes a rib 114 which is of the same configuration as ribs 114 (FIGS. 21 and 29), and bottom rib 114 rests on shelf 111 (FIG. 28) which is molded integrally with sides 24 of central frame channel rail 19.

After the ladders 15 have been positioned as described above, the bases or feet 14 are connected to bottom frame channel rails 22 in the above described manner to complete the assembly and capture the ladders 15 in the above described positions. The in-pool ladder (FIG. 2) can then be locked in position by the use of two carriage bolts 112 (FIGS. 21 and 22) on each side of the ladder. Each of the lower bolts extend through an aperture 49 in the surface 45 of bottom frame channel rail 22 and a pair of aligned bores 113 in each leg 73 of each ladder rail 71. The sides 73 are maintained in spaced relationship by ribs 114.

Further in accordance with the present invention, the external ladder 15, that is, the one which is not within the pool and locked in position, as discussed above, can be slid within the sides 12 of the A-frame from the position of FIG. 1 to a locked position of FIG. 2 because the sides 24 of central frame channel rail 19 and the sides 109 of top frame channel rail 20 will guide the rails 71 of ladder 15 between the positions shown in FIGS. 1 and 2.

A latching mechanism is provided to maintain ladder 15 in its uppermost position of FIG. 2 (FIGS. 27, 31, 32, 33, 34 and 35). In this respect, the latch 115 includes an elongated portion 117 which is formed integrally with side 119 of top frame channel rail 20 and it pivots about portion 120 (FIG. 27) which acts as a living hinge. Further in this respect, slots 121 separate member 117 from the remainder of side 119. At the lower end of member 117, the latch 122 is located. In its lowermost position, the ladder 15 will be in the positions of FIGS. 27 and 32. When it is desired to move the ladder upwardly to its position of FIG. 2, the edge 123 (FIG. 32) of ladder 15 will run along cam surface 124 and bias elongated portion 117 outwardly to the position of FIG. 34 as the side of ladder rail 71 moves upwardly until it reaches the position of FIG. 35 at which time latch 122 will return to the position of FIGS. 32 and 35, and thereafter surface 125 of latch 115 will retain ladder 15 in the position of FIG. 35. A padlock 127 may be inserted through aligned apertures 129 and 130 in tab 131 on latch member 115 and tab 132 on side 34 of part 32 of top frame channel rail 20. To lower the ladder 15 to the position of FIG. 1, the latch 115 can be pulled to the position of FIG. 34, and the ladder can be pulled downwardly.

Figure 26:
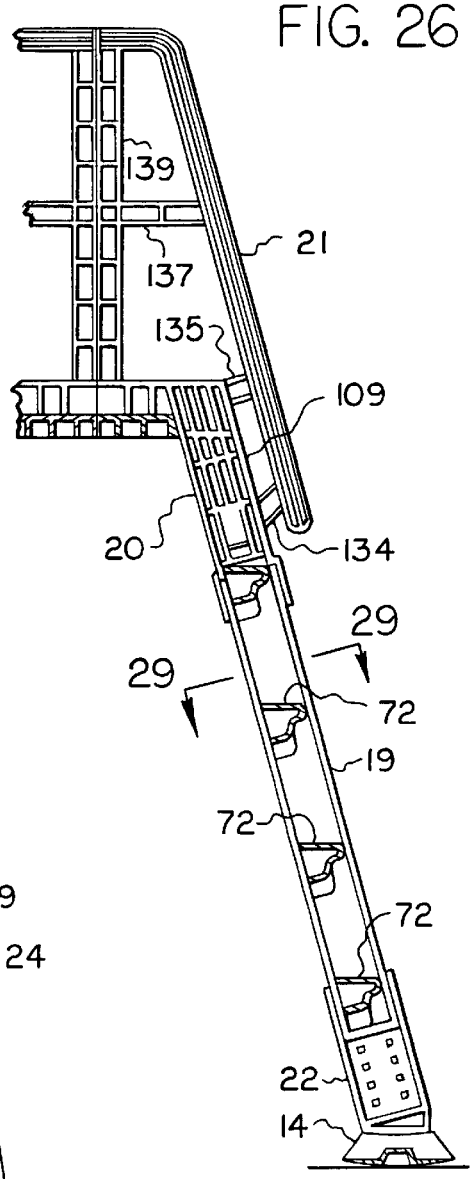
FIG. 26 is a fragmentary cross sectional view taken substantially along line 26—26 of FIG. 5.
Figure 28:
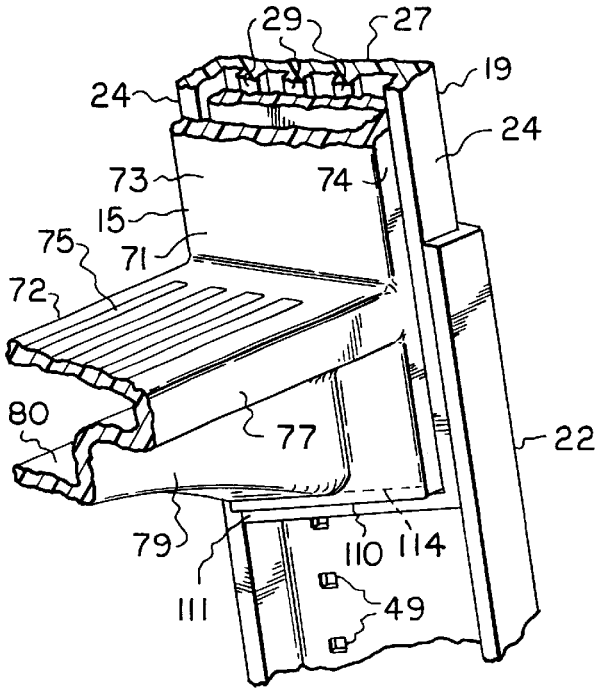
FIG. 28 is a fragmentary perspective view of the ladder in its lowermost position on the frame channel rail.
Figure 32:
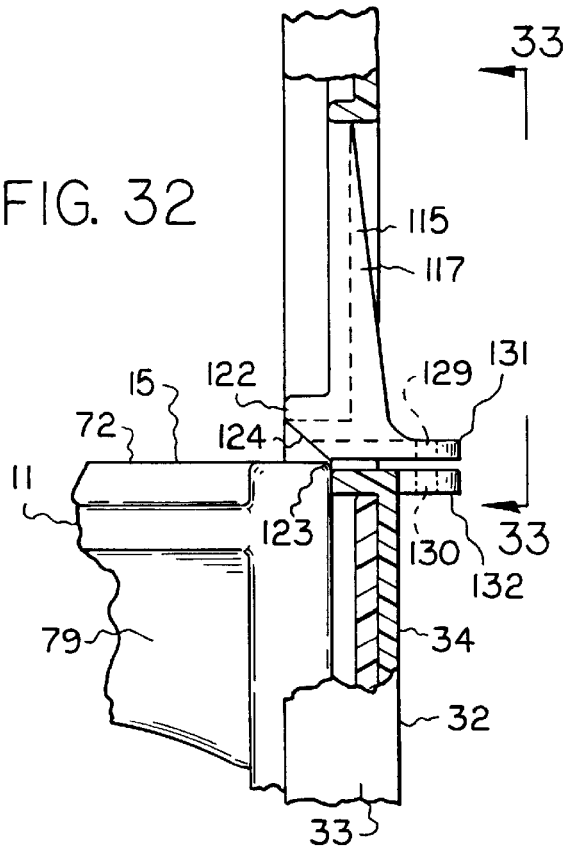
FIG. 32 is a partially broken away fragmentary cross sectional view taken substantially along line 32—32 of FIG. 31 showing the ladder in its lowermost position.
Figure 33:
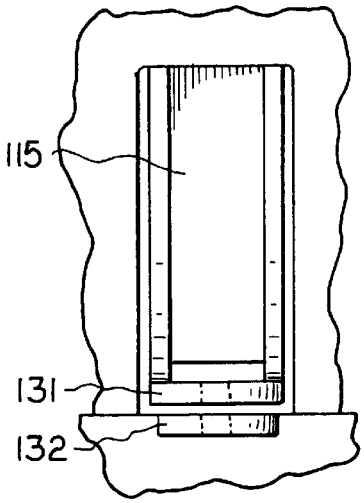
FIG. 33 is a fragmentary view of the latch structure taken substantially in the direction of arrows 33—33 of FIG. 32.
Figure 34:
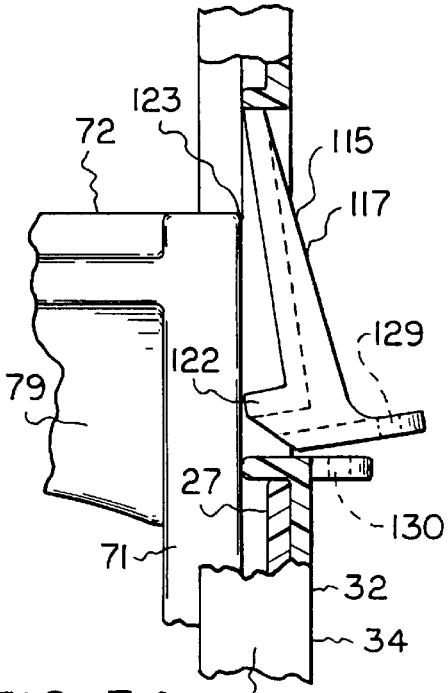
FIG. 34 is a view similar to FIG. 32 but showing the ladder displacing the latch during its upward movement.
Figure 35:
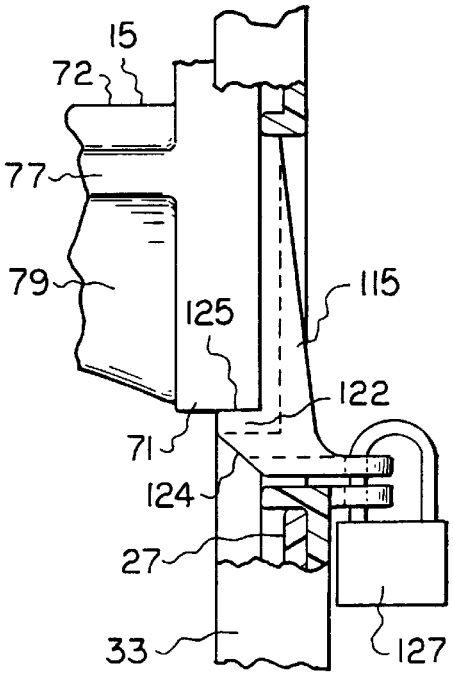
FIG. 35 is a view similar to FIG. 34 but showing the ladder in a latched uppermost position and locked with a padlock against downward movement.

As noted above, the hand rails 21 are integrally molded parts of top frame channel rail 20. In this respect, struts 134 and 135 extend outwardly from side 109 (FIG. 27) and strut 137 (FIG. 26) extends between post 139 and hand rail 21. As noted above, all of the foregoing parts are molded integrally.

Figure 4:
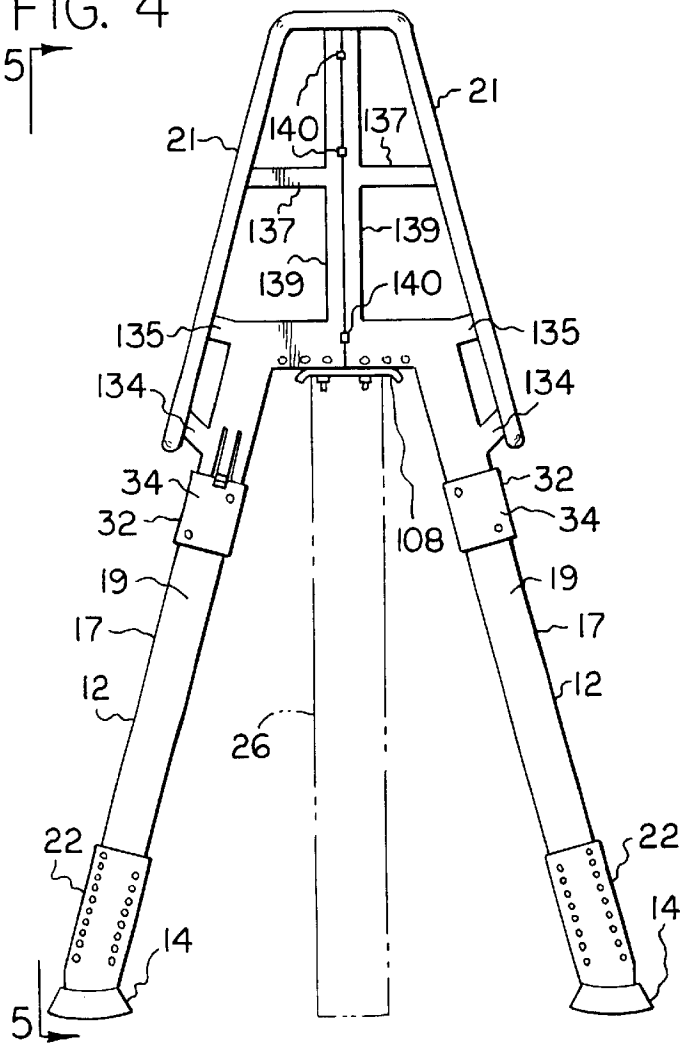
FIG. 4 is a side elevational view of the ladder assembly taken substantially in the direction of arrows 4—4 of FIG. 5.
Figure 16:
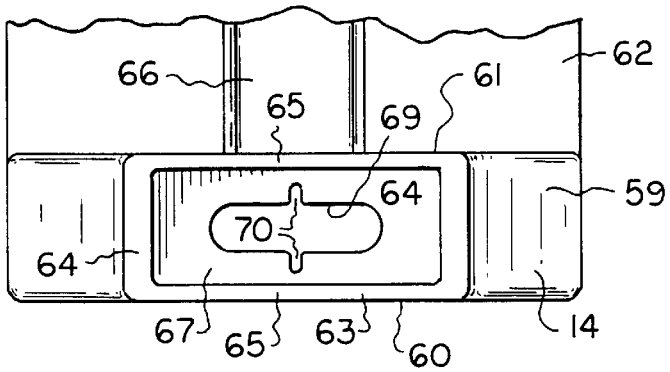
FIG. 16 is a fragmentary enlarged view of the end of the pivotal base taken substantially in the direction of arrows 16—16 of FIG. 3.
Figure 17:
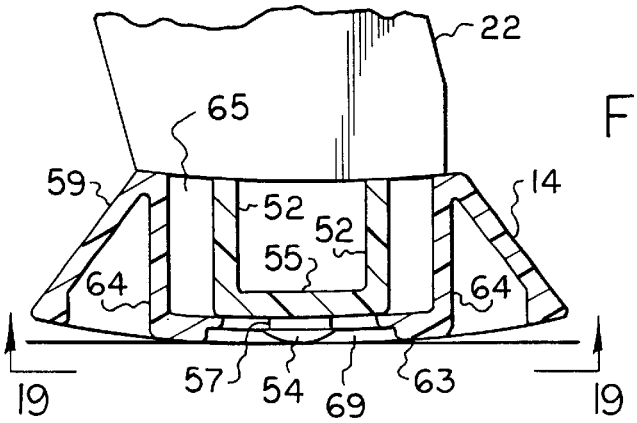
FIG. 17 is a fragmentary cross sectional view taken substantially along line 17—17 of FIG. 19.

The assembled center posts 139 of top frame channel rails 20 are located in adjacent relationship as shown in FIGS. 1, 2 and 4, and they are bolted together at a plurality of points 140 (FIG. 4) along their lengths. In this respect, each post 139 is of channel-shaped construction (FIGS. 12A and 12B) with the sides 141 of pairs of posts facing each other so that the outer sides 142 face the outside of the completed assembled ladder assembly 10 (FIG. 2). Slots 143 (FIG. 12A) are provided in channel sides 141 which abut each other, as shown in FIG. 12B, and a carriage bolt 144 is installed through adjacent slots 43 at three locations lengthwise of posts 139 to hold them in assembled relationship. The assembled posts 139 add rigidity to the structure and also provide ends to which a fence on the top rail 108 can be secured.

Figure 36:
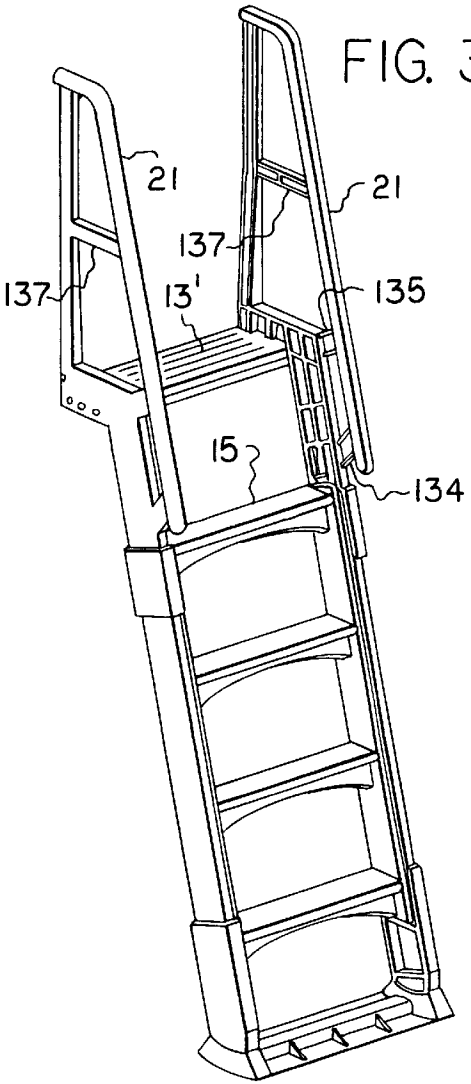
FIG. 36 is a perspective view of a half of the ladder assembly which can be used strictly as a ground-to-deck ladder and which has the structure for moving the ladder on the frame channel rails to an uppermost locked position.

FIG. 36 is a perspective view of half a ladder assembly which can be used solely as a ground to deck ladder and which has the structure described above for moving the ladder on the frame channel rails to an uppermost locked position. In this embodiment a half deck platform 13' can be used which is identical to one half of the platform structure 13 described above.

Figure 37:
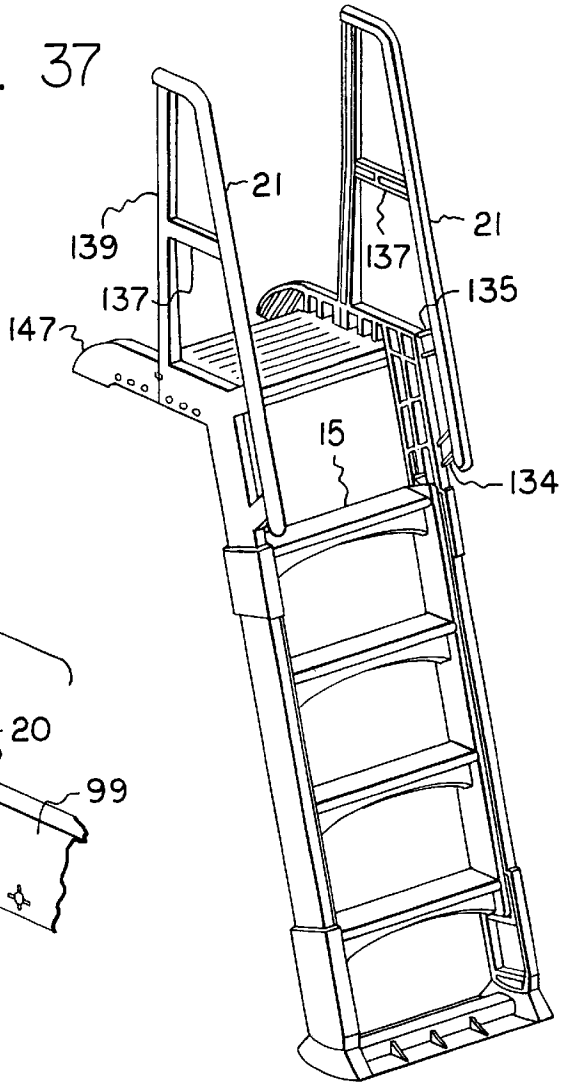
FIG. 37 is a perspective view of a half ladder, the half ladder assembly which can be utilized as an in-pool ladder and having an added lip structure mounted thereon.
Figure 38:
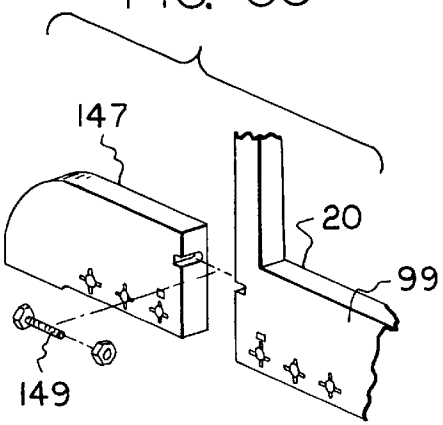
FIG. 38 is a fragmentary perspective view of the platform of the in-pool ladder having the lip attachment associated therewith.

In FIG. 37 there is a perspective view of half a ladder which can be utilized as an in-pool ladder having an added lip structure mounted thereon. In this respect, the in-pool ladder of FIG. 37 may be identical to half a ladder described above which is utilized within the pool and has the ladder 15 locked against upward sliding movement, as described above. If desired, lip extensions 147 can be secured to sides 99 of the top frame channel rails 20 by means of bolts 149 which function in the same manner as described above relative to FIGS. 12A and 12B.

In FIGS. 39–47 a modified embodiment of the present ladder construction is shown. The modification broadly includes the placement of tabs in the original central frame channel rails 19 and original top frame channel rails 20 which are received in modifications of original ladder rails 71. In FIGS. 39–47 modifications of the parts of FIGS. 1–38 will generally be designated by primed numerals which correspond to unprimed numerals of analogous parts in FIGS. 1–38.

Figure 40:
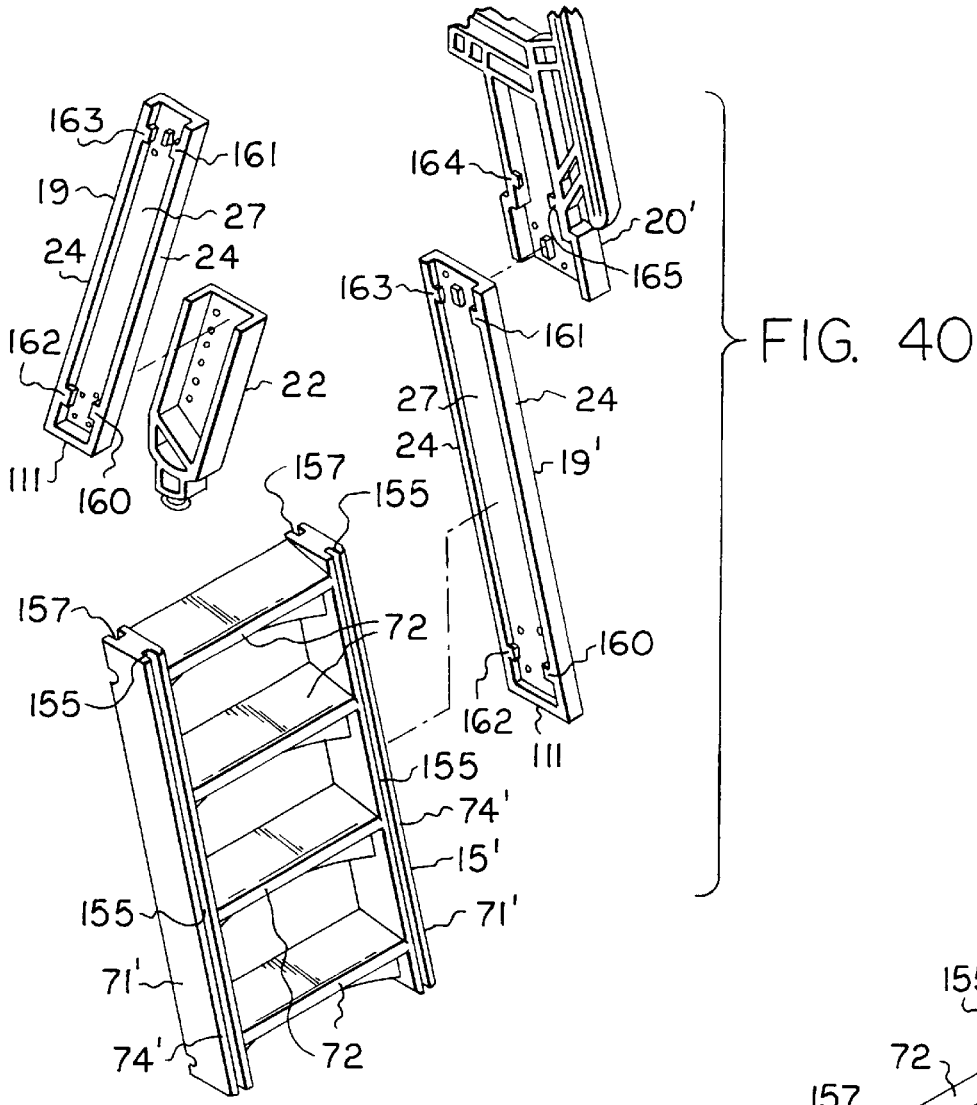
FIG. 40 is an enlarged modification of a portion of FIG. 3 showing the opposite side of the ladder of FIG. 39 and also showing a modified central frame channel rail and a modified top frame channel rail.

In FIGS. 39, 40, 41, 45 and 46 a modified ladder 15' is shown. The ladder rails 71' are modifications of ladder rails 71. One modification is that the original web 74 (FIG. 29) of the ladder rails 71 has been modified as shown at 74' in FIGS. 40 and 46 to have a groove 155 therein which extends throughout the length thereof (FIG. 40). Also, original ladder rail end 107 of FIG. 20 has been modified to the configuration 107' to have a slot 157 (FIG. 45) at one end and the groove 155 extending therethrough at the other end. In addition, the original ribs 114 (FIG. 21) which previously extended all the way to the ends of channel sides 73 have been cut back to end at 159 (FIG. 46) and thus the ribs 114' (FIGS. 41, 45 and 46) are shorter than the previous ribs 114 (FIG. 45) so as to clear the tabs adjacent to rib ends 159 when the ladder is moved from its lower position of FIG. 1 to its higher position of FIG. 2.

Figure 46:
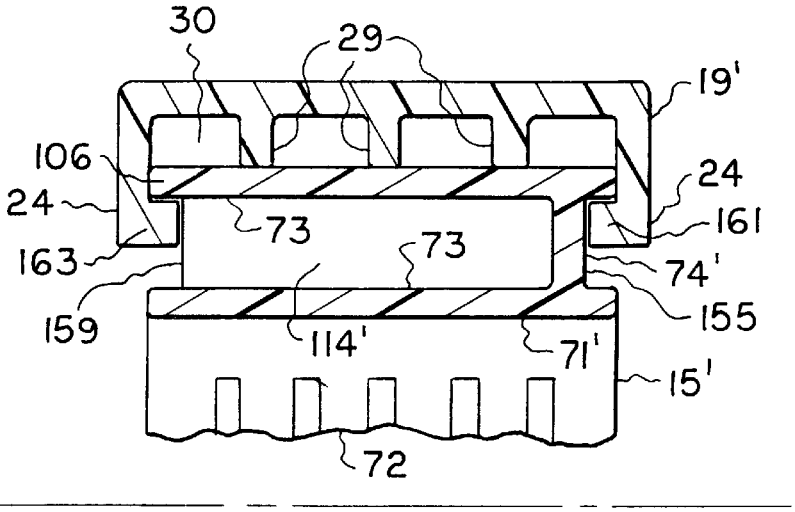
FIG. 46 is an enlarged view similar to FIG. 29 but showing the modified ladder rail mounted within the modified central frame channel rail.

The groove 155 in modified web 74' (FIGS. 45 and 46) receives tabs 160 and 161 (FIG. 40) when the ladder 15' is in its lowermost position. The modified central frame channel rail 19' (FIG. 40) also has tabs 162 and 163 therein (FIG. 40) which lie abreast the end 106 of one of the sides 73 of ladder rail 71' (FIG. 46). Thus, when the ladder 15' is in its lower position, as shown in FIG. 1, the tabs 160 and 161 (FIG. 40) lie in groove 155 and tabs 162 and 163 lie adjacent to the end 106 of ladder rail side 73. Thus, the tabs 160, 161, 162 and 163 in the modified central frame channel rails 19' receive spaced ladder rails 71'. This prevents the central frame channel rails 19' on opposite sides of ladder 15' from bowing outwardly.

Figure 44:
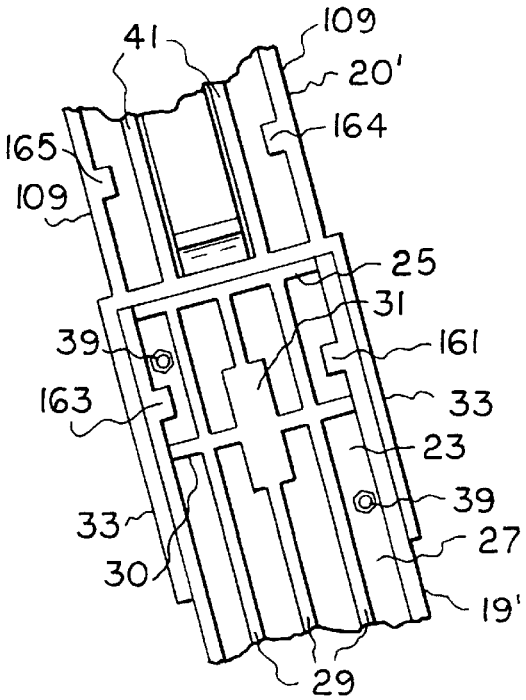
FIG. 44 is an enlarged view similar to FIG. 8 but showing the central frame channel rail with tabs at the upper portion thereof.
Figure 45:
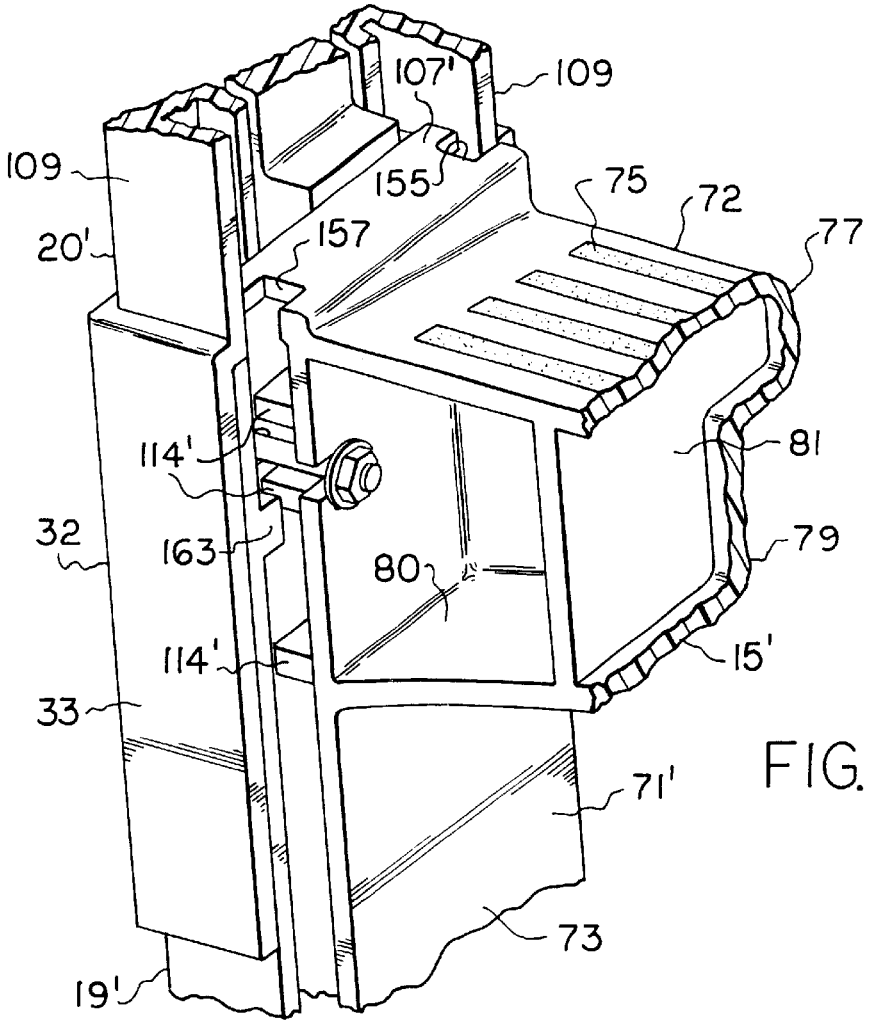
FIG. 45 is a view similar to FIG. 20 but showing the configuration of the modified ladder rails and a tab in the upper portion of the central frame channel rail.
Figure 47:
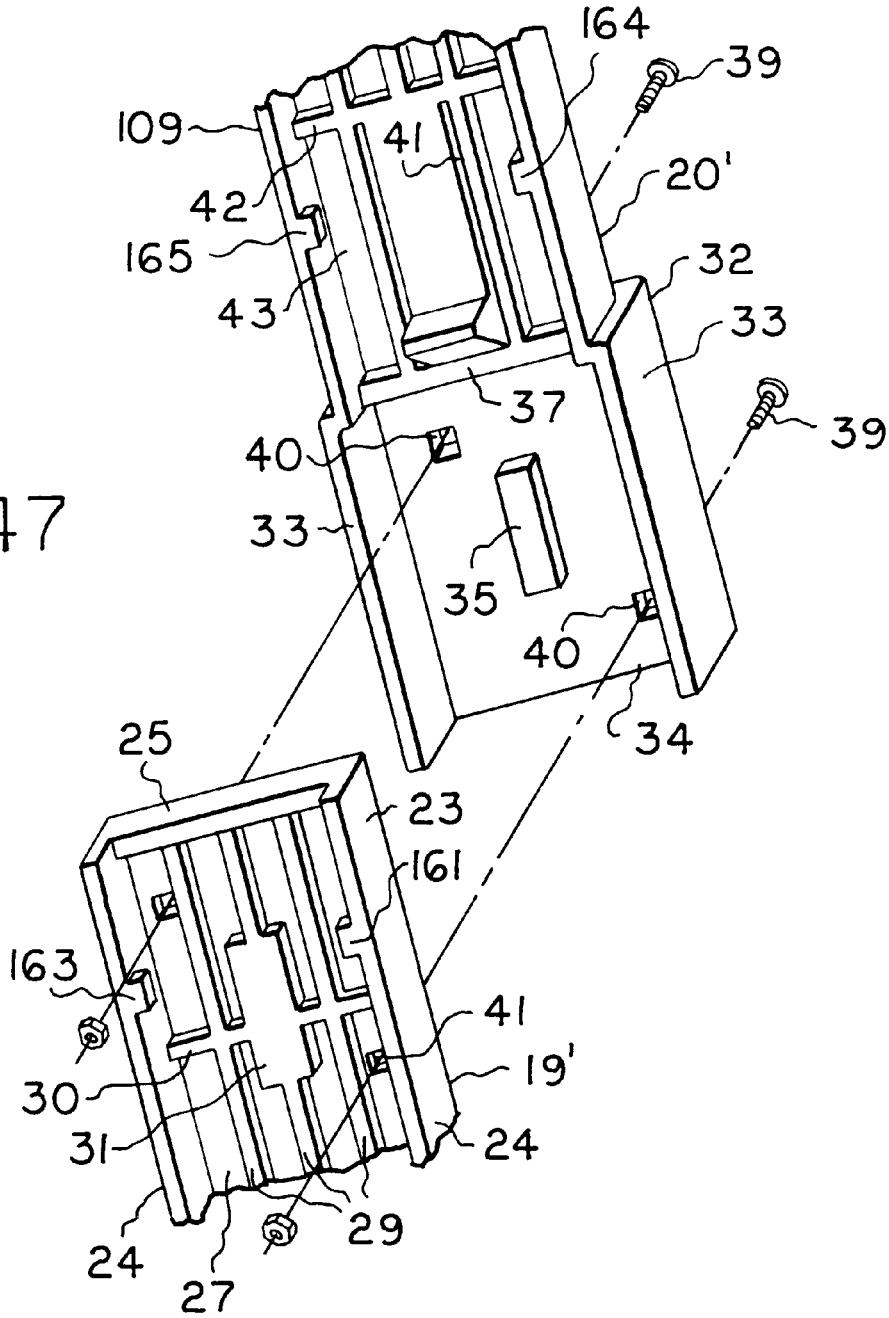
FIG. 47 is an enlarged fragmentary exploded view similar to FIG. 7 but showing the modified central frame channel rail and modified top frame channel rail with tabs therein.
Figure 48:
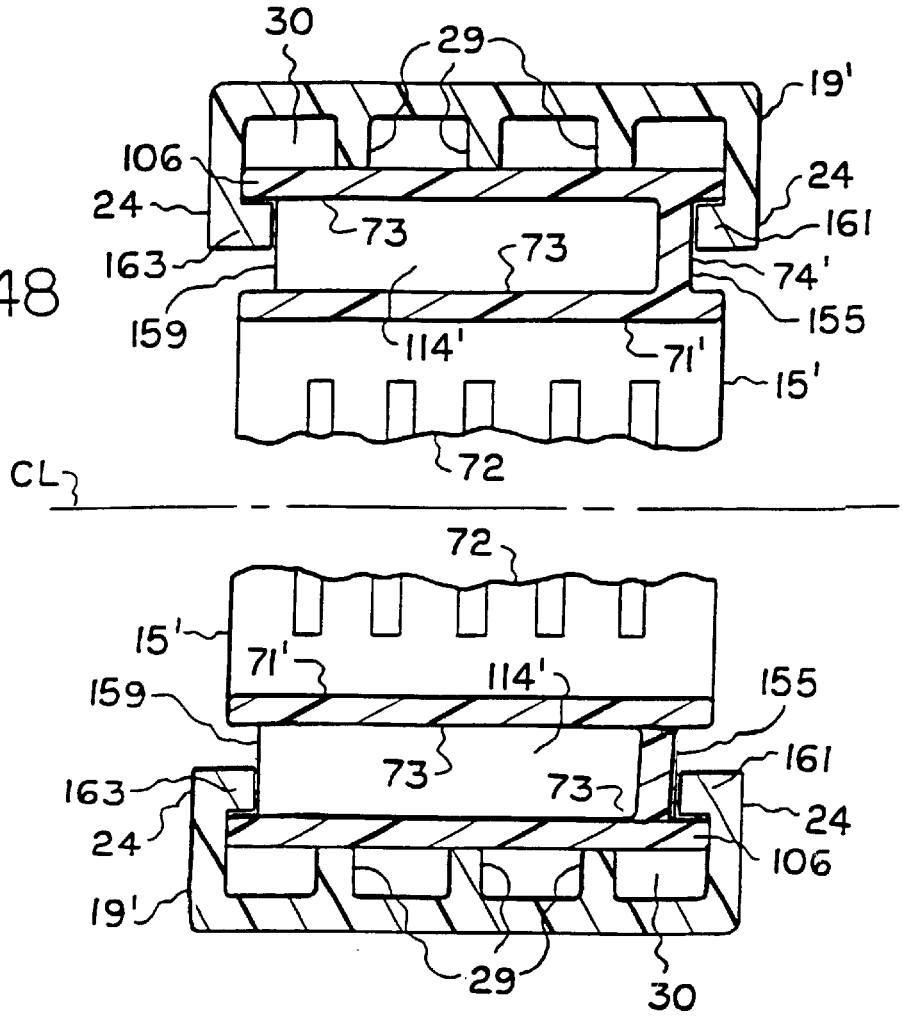
FIG. 48 is an amplification of FIG. 46 also showing the mirror image structure on the opposite side of the centerline.

In addition to the foregoing, tabs 164 and 165 are provided in top frame channel rail 20' (FIGS. 44 and 47). When the ladder 15' is in the upper position of FIG. 2, tabs 161 and 165 will be received in groove 155 and tabs 163 and 164 will lie abreast the end 106 of side 73. The existence of tabs 164 and 165 in the top frame channel rail 20' will prevent the top frame channel rails 20' on opposite sides of each ladder rail 71' from bowing outwardly, thereby preventing the latch 115 from being pulled out of engagement with the ladder in its upper position. The foregoing will also prevent the lower portions of hand rails 21 from bowing downwardly.

All of the tabs 160, 161, 162, 163, 164 and 165 have been shown as being of substantially equal length. While they have been shown as constituting a relatively small portion of the length of the part on which they are located, it will be appreciated that they could be longer. Also, it will be appreciated that in the central frame channel rails 19', if desired, the tabs can extend for substantial portions of the length thereof so that they in fact become flanges. However, it is preferably that there be a plurality of spaced tabs on each side of the central frame channel rails 19; which can be two or more. Alternatively, a single relatively long tab, which is longer than those shown but does not extend for substantially the entire length of the central frame channel rail 19' can be located on each side of the frame channel rail 19'.

While FIGS. 41–47 show only one frame side rail and in certain instances only one ladder side rail, it will be appreciated that the structure shown therein is representative of all of the four frame side rails and all of the four ladder side rails of the A-frame ladder.

Figure 39:
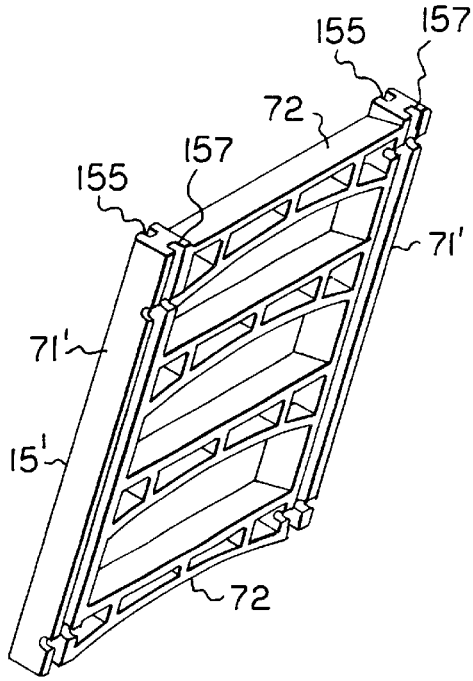
FIG. 39 is an enlarged portion of FIG. 3 showing a modified ladder which is used with modified frame channel rails having tabs therein.
Figure 41:
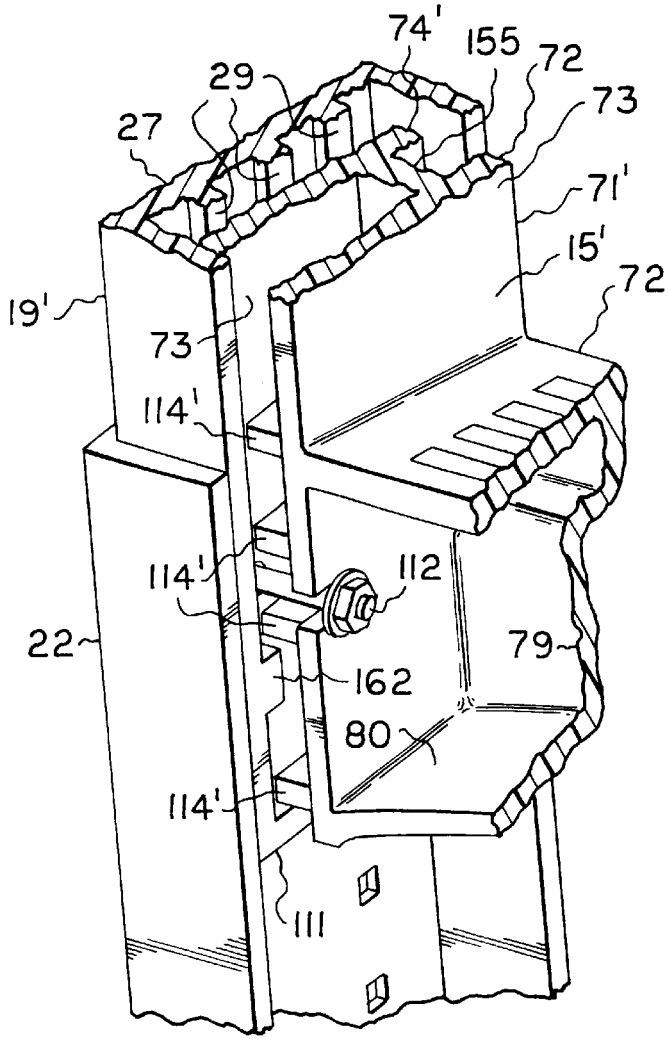
FIG. 41 is a modification of FIG. 21 showing a modified ladder rail and a tab in the central frame channel rail.
Figure 42:
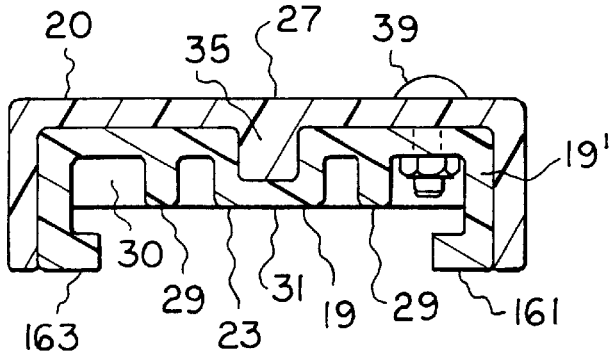
FIG. 42 is an enlarged cross sectional view similar to FIG. 9 but showing a modified central frame channel rail with tabs thereon.
Figure 43:
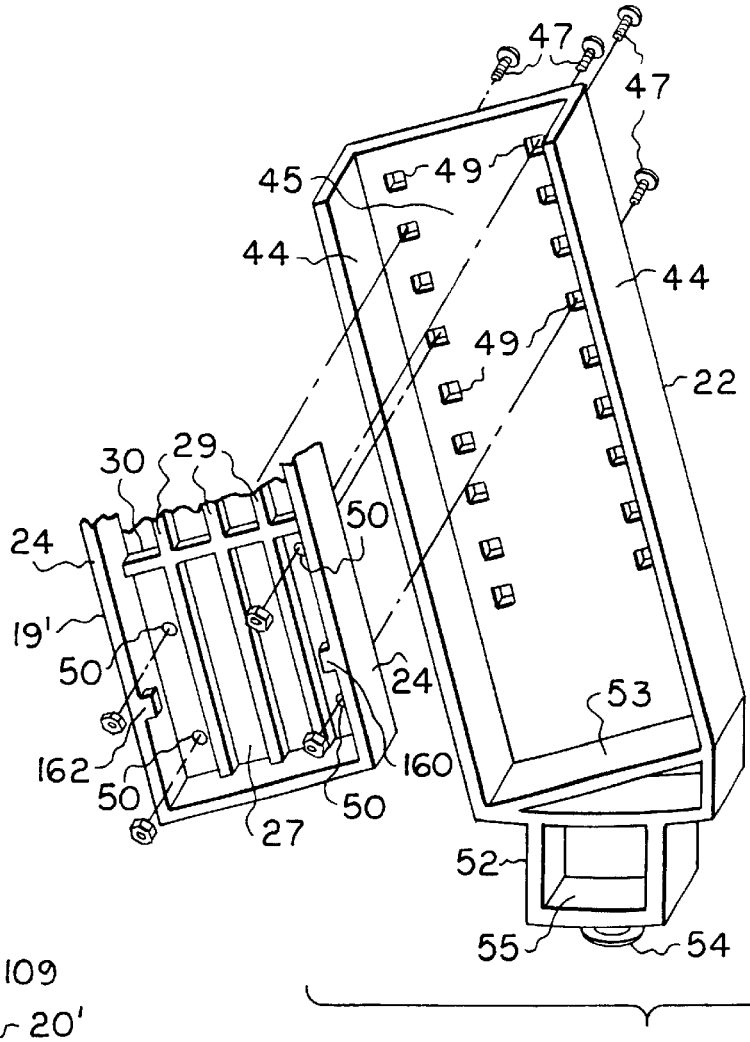
FIG. 43 is an enlarged fragmentary view similar to FIG. 10 but showing the central frame channel rail with tabs at the lower portion thereof.

The centerline CL in FIG. 46 represents that there are present, but not shown, mirror image counterparts of the structure shown in FIG. 46, as can be visualized from FIGS. 39 and 40. Furthermore, it will be appreciated that the embodiment of FIGS. 39–47 constitutes an A-frame ladder which has all of the basic parts of the A-frame ladder of FIGS. 1–38 and which has the modifications described above in FIGS. 39–47, namely, the four central frame channels 19', the four top frame channels 20', and the two ladders 15' which include the four ladder rails 71' having the ribs 114' and the grooves 155.

While preferred embodiments of the present invention have been disclosed, it will be appreciated that the present invention can be otherwise embodied within the scope of the following claims.

Sequence Listing

Not Applicable

What is claimed is:

1. A molded plastic pool ladder assembly comprising an A-frame, first and second sides on said A-frame, first and second opposed frame channel rail structures on each of said first and second sides of said A-frame, and first and second ladders having first and second opposed side rails in said first and second opposed frame channel rail structures, respectively, at least one of said first and second ladders being slidable between a lower and a higher position in one of said first and second opposed frame channel rail structures, and a latch structure molded integrally on one of said frame channel rail structures for retaining said at least one of said ladders in said higher position, said latch structure comprising a tab molded integrally at a position on one side of one of said first and second opposed frame channel rail structures, a cam surface on said tab remote from said position, and a ladder position-retaining surface on said tab.

2. A molded plastic pool ladder assembly comprising an A-frame, first and second sides on said A-frame, first and second opposed frame channel rail structures on each of said first and second sides of said A-frame, and first and second ladders having first and second opposed side rails in said first and second opposed frame channel rail structures, respectively, both of said first and second opposed frame channel rail structures including first and second opposed central frame channel rails, first and second opposed top frame channel rails secured to first ends of said opposed central frame channel rails, and first and second opposed bottom frame channel rails secured to the second ends of said central frame channel rails, said opposed central channel rail structures and said opposed top frame channel rails being secured to each other by a first combination of interfitting parts and bolts, and said opposed central rail structure and said opposed bottom channel rails being secured to each other by a second combination of interfitting parts and bolts.

3. A molded plastic pool ladder assembly comprising an A-frame, first and second sides on said A-frame, first and second opposed frame channel rail structures on each of said first and second sides of said A-frame, and first and second ladders having first and second opposed side rails in said first and second opposed frame channel rail structures, respectively, both of said first and second opposed frame channel rail structures including first and second opposed central frame channel rails, first and second opposed top frame channel rails secured to first ends of said opposed central frame channel rails, and first and second opposed bottom frame channel rails secured to the second ends of said central frame channel rails, first and second opposed hand rails molded integrally with said first and second opposed top frame channel rails, each of said first and second opposed top frame channel rails including first and second opposed center posts molded integrally therewith, and means for securing said first opposed center posts to said second opposed center posts.

4. The molded plastic pool ladder assembly as set forth in claim 3 including first and second opposed laterally extending sides molded integrally with said first and second opposed top frame channel rails, respectively, and a platform secured between said first opposed laterally extending sides and said second opposed laterally extending sides.

5. The molded plastic pool ladder assembly as set forth in claim 4 wherein said platform is secured to said first and second opposed laterally extending sides by means of button connections.

6. A molded plastic pool ladder assembly comprising an A-frame, first and second sides on said A-frame, opposed channels on said first side, a first ladder, side rails on said first ladder in said opposed channels on said first side, a second ladder on said second side, said first ladder being movable in said opposed channels between lower and higher positions, and a latch molded integrally on one of said opposed channels for latching said first ladder in said higher position, said latch comprising a tab molded integrally at a position on one of said channels, a cam surf ace on said tab remote from said position, and a ladder position-retaining surface on said tab.

7. A molded plastic pool ladder assembly comprising an A-frame; first and second sides on said A-frame; opposed frame channel rail structures on said first side; opposed central frame channel rails and opposed top frame channel rails and opposed bottom frame channel rails on said opposed frame channel rail structures; first interfitting connections between each of said central frame channel rails and said top frame channel rails; second interfitting connections between said central frame channel rails and said bottom frame channel rails; and opposed bases mounted on said bottom frame channel rails, said opposed bases being mounted on said bottom frame channel rails by buttons protruding from said bottom frame channel rails into slots in said bases.

8. The molded plastic pool ladder assembly as set forth in claim 7 including box-like extensions on said bottom frame channel rails mounting said buttons, and box-like structures on said bases receiving said box-like extensions.

9. A molded plastic pool ladder assembly comprising an A-frame, first and second sides on said A-frame, first and second opposed channel rails on at least said first side of said A-frame, a ladder, first and second ladder rails on said ladder in said first and second channel rails, respectively, at least one first tab in said first channel rail, at least one second tab in said second channel rail, a first groove in said first ladder rail which receives said first tab, and a second groove in said second ladder rail which receives said second tab, said first channel rail including first and second opposed channel rail sides, and said second channel rail including third and fourth opposed channel rail sides, and said at least one first tab being located on said first channel rail side, and said at least one second tab being located on said third channel rail side.

10. The molded plastic pool ladder assembly as set forth in claim 9 wherein said A-frame includes substantial mirror image counterparts of said first side of said A-frame on said second side of said A-frame.

11. The molded plastic pool ladder assembly as set forth in claim 9 including at least one third tab on said second channel rail side, and at least one fourth tab on said fourth channel rail side.

12. The molded plastic pool ladder assembly as set forth in claim 11 wherein said A-frame includes substantial mirror image counterparts of said first side of said A-frame on said second side of said A-frame.

13. The molded plastic pool ladder assembly as set forth in claim 11 wherein said first ladder rail includes first and second opposed ladder rail sides, and wherein said second ladder rail includes third and fourth ladder rail sides, and wherein said at least one third tab is located between said first and second ladder rail sides, and wherein said at least one fourth tab is located between said third and fourth ladder side rail sides.

14. The molded plastic pool ladder assembly as set forth in claim 13 wherein said A-frame includes substantial mirror image counterparts of said first side of said A-frame on said second side of said A-frame.

15. The molded plastic pool ladder assembly as set forth in claim 13 wherein said first ladder rail is in the configuration of a first U-shape, and wherein said first and second opposed ladder rail sides are connected by a first web having said first groove therein, and wherein said second ladder rail is in the configuration of a second U-shape, and wherein said third and fourth opposed ladder rail sides are connected by a second web having said second groove therein.

16. The moped plastic pool ladder assembly as set forth in claim 15 wherein said A-frame includes substantial mirror image counterparts of said first side of said A-frame on said second side of said A-frame.

17. The molded plastic pool ladder assembly as set forth in claim 15 including a plurality of first ribs connecting said first web and said first and second rail sides, and a plurality of second ribs connecting said second web and said third and fourth rail sides.

18. The molded plastic pool ladder assembly as set forth in claim 17 wherein said A-frame includes substantial mirror image counterparts of said first side of said A-frame on said second side of said A-frame.

19. The molded plastic pool ladder assembly as set forth in claim 17 wherein said first ribs have first ends remote from said first web and which are proximate said second channel rail side, and wherein said second ribs have second ends remote from said second web and which are proximate said fourth channel rail side.

20. The molded plastic pool ladder assembly as set forth in claim 19 wherein said A-frame includes substantial mirror image counterparts of said first side of said A-frame on said second side of said A-frame.

21. A molded plastic pool ladder assembly comprising an A-frame, first and second sides on said A-frame, first and second opposed channel rails on at least said first side of said A-frame, a ladder, first and second ladder rails on said ladder in said first and second channel rails, respectively, at least one first tab in said first channel rail, at least one second tab in said second channel rail, a first groove in said first ladder rail which receives said first tab, and a second groove in said second ladder rail which receives said second tab, a plurality of first tabs on said first channel rail and in said first groove, and a plurality of second tabs on said second channel rail and in said second groove.

22. The molded plastic pool ladder assembly as set forth in claim 21 wherein said A-frame includes substantial mirror image counterparts of said first side of said A-frame on said second side of said A-frame.

23. The molded plastic pool ladder assembly as set forth in claim 21 wherein said first channel rail includes first and second opposed channel rail sides, and wherein said second channel rail includes third and fourth opposed channel rail sides, and wherein said plurality of first tabs are located on said first channel rail side, and wherein said plurality of second tabs are located on said third channel rail side.

24. The molded plastic pool ladder assembly as set forth in claim 23 wherein said A-frame includes substantial mirror image counterparts of said first side of said A-frame on said second side of said A-frame.

25. The molded plastic pool ladder assembly as set forth in claim 23 including a plurality of third tabs on said second channel rail side, and a plurality of fourth tabs on said fourth channel rail side.

26. The molded plastic pool ladder assembly as set forth in claim 25 wherein said A-frame includes substantial mirror image counterparts of said first side of said A-frame on said second side of said A-frame.

27. The molded plastic pool ladder assembly as set forth in claim 25 wherein said first ladder rail includes first and second opposed ladder rail sides, and wherein said second ladder rail includes opposed third and fourth ladder rail sides, and wherein said plurality of first tabs are located between said first and second ladder rail sides, and wherein said plurality of second tabs are located between said third and fourth ladder side rail sides.

28. The molded plastic pool ladder assembly as set forth in claim 27 wherein said first ladder rail is in the configuration of a first U-shape, and wherein said first and second opposed ladder rail sides are connected by a first web having said first groove therein, and wherein said second ladder rail is in the configuration of a second U-shape, and wherein said third and fourth opposed ladder rail sides are connected by a second web having said second groove therein.

29. The molded plastic pool ladder assembly as set forth in claim 28 wherein said A-frame includes substantial mirror image counterparts of said first side of said A-frame on said second side of said A-frame.

30. The molded plastic pool ladder assembly as set forth in claim 28 including a plurality of first ribs connecting said first web and said first and second ladder rail sides, and a plurality of second ribs connecting said second web and said third and fourth ladder rail sides.

31. The molded plastic pool ladder assembly as set forth in claim 30 wherein said A-frame includes substantial mirror image counterparts of said first side of said A-frame on said second side of said A-frame.

32. The molded plastic pool ladder assembly as set forth in claim 30 wherein said first ribs have first ends which are remote from said first web and positioned between said first and second ladder rail sides, and wherein said second ribs have second ends which are remote from said second web and positioned between said third and fourth ladder rail sides.

33. The molded plastic pool ladder assembly as set forth in claims 32 wherein said A-frame includes substantial mirror image counterparts of said first side of said A-frame on said second side of said A-frame.

34. The molded plastic pool ladder assembly as set forth in claim 32 wherein said second tabs are positioned between said first and second ladder rail sides proximate said first ends of said first ribs, and wherein said fourth tabs are positioned between said third and fourth ladder rail sides proximate said second ends of said second ribs.

35. A molded plastic pool ladder assembly comprising first and second opposed channel rails, first channel rail sides connected by a first channel rail web on said first channel rail, second channel rail sides connected by a second channel rail web on said second channel rail, said first channel rail sides being in substantial alignment with said second channel rail sides, a ladder, first and second spaced ladder rails on said ladder, first ladder rail sides connected by a first ladder rail web on said first ladder rail, second ladder rail sides connected by a second ladder rail web on said second ladder rail, said first ladder rail web extending into the space between said first channel rail sides, said second ladder rail web extending into the space between said second channel rail sides, said first ladder rail sides extending transversely to said first channel rail sides, said second ladder rail sides extending transversely to said second channel rail sides, first ribs between said first ladder rail sides, second ribs between said second ladder rail sides, said first ribs being molded integrally with said first ladder rail sides, said second ribs being molded integrally with said second ladder rail sides, said first ribs having first and second ends with said first ends of said first ribs being proximate said first ladder rail web and said second ends of said first ribs being remote from said first ladder rail web, said first ladder rail sides having first ends proximate said first ladder rail web and second ends remote from said first ladder rail web, said second ends of said first ribs being spaced inwardly from at said second end of at least one of said first ladder rail sides, said second ribs having first and second ends with said first ends of said second ribs being proximate said second ladder rail web and said second ends of said second ribs being remote from said second ladder rail web, said second ladder rail sides having first ends proximate said second ladder rail web and second ends remote from said second ladder rail web, and said second ends of said second ribs being spaced inwardly from said second end of at least one of said second ladder rail sides.

36. The molded plastic pool ladder assembly as set forth in claim 35 which is the first of two sides of an A-frame and which includes substantial mirror image counterparts of said first side of said A-frame on the other of said two sides of said A-frame.

37. The molded plastic pool ladder assembly as set forth in claim 35 wherein said first ladder rail web has a first groove therein which extends longitudinally thereof, at least one first tab on one of said first channel rail sides in said first groove, and wherein said second ladder rail web has a second groove therein which extends longitudinally thereof, and at least one second tab on one of said second channel rail sides in said second groove.

38. The molded plastic pool ladder assembly as set forth in claim 37 which is the first of two sides of an A-frame and which includes substantial mirror image counterparts of said first side of said A-frame on the other of said two sides of said A-frame.

39. The molded plastic pool ladder assembly as set forth in claim 37 including at least one third tab on the other of said first channel rail sides which extends into space between said second ends of said first ladder rail sides, and at least one fourth tab on the other of said second channel rail sides which extends into a space between said second ends of said second ladder rail sides.

40. The molded plastic pool ladder assembly as set forth in claim 39 which is the first of two sides of an A-frame and which includes substantial mirror image counterparts of said first side of said A-frame on the other of said two sides of said A-frame.

41. The molded plastic pool ladder assembly as set forth in claim 39 including a plurality of said first tabs on said one of said first channel rail sides and in said first groove, and a plurality of said second tabs on said one of said second channel rail sides in said second groove.

42. The molded plastic pool ladder assembly as set forth in claim 41 which is the first of two sides of an A-frame and which includes substantial mirror image counterparts of said first side of said A-frame on the other of said two sides of said A-frame.

43. The molded plastic pool ladder assembly as set forth in claim 41 including a plurality of said third tabs on said other of said first channel rail sides which extend into said space between said second ends of said first channel rail sides, and a plurality of fourth tabs on said other of said second channel rail sides which extend into said space between said second ends of said second ladder rail sides.

44. The molded plastic pool ladder assembly as set forth in claim 43 which is the first of two sides of an A-frame and which includes substantial mirror image counterparts of said first side of said A-frame on the other of said two sides of said A-frame.

45. The molded plastic pool ladder assembly as set forth in claim 35 including at least one first tab on one of said first channel rail sides, at least one second tab on one of said second channel rail sides, said second end of said at least one of said first ladder rail sides being positioned between said at least one first tab and said first channel rail web, and said second end of said at least one of said second ladder rail sides being positioned between said at least one second tab and said second channel rail webs.

46. The molded plastic pool ladder assembly as set forth in claim 45 which is the first of two sides of an A-frame and which includes substantial mirror image counterparts of said first side of said A-frame on the other of said two sides of said A-frame.

47. The molded plastic pool ladder assembly as set forth in claim 45 including at least one third tab on the other of said first channel rail sides, at least one fourth tab on the other of said second channel rail sides, said first end of said at least one of said first ladder rail sides being positioned between said at least one third tab and said first channel rail web, and said first end of said at least one of said second ladder rail sides being positioned between said fourth tab and said second channel rail web.

48. The molded plastic pool ladder assembly as set forth in claim 47 which is the first of two sides of an A-frame and which includes substantial mirror image counterparts of said first side of said A-frame on the other of said two sides of said A-frame.

49. The molded plastic pool ladder assembly as set forth in claim 45 including a plurality of said first tabs on said one of said first channel rail sides, and a plurality of said second tabs on said one of said second channel rail sides, and a plurality of said third tabs on said other of said first channel rail sides, and a plurality of said fourth tabs on said other of said second channel rail sides, said second end of said at least one of said first ladder rail sides being positioned between said plurality of said first tabs and said first channel rail web, said second end of said at least one of said second ladder rail sides being positioned between said plurality of said second tabs and said second channel rail web, said first end of said at least one of said first ladder rail sides being positioned between said plurality of third tabs and said first channel rail web, and said first end of said at least one of said second ladder rail sides being positioned between said fourth tabs and said second channel rail web.

50. The molded plastic pool ladder assembly as set forth in claim 49 which is the first of two sides of an A-frame and which includes substantial mirror image counterparts of said first side of said A-frame on the other of said two sides of said A-frame.

* * * * *